US009256908B2

(12) United States Patent
Dai et al.

(10) Patent No.: US 9,256,908 B2
(45) Date of Patent: Feb. 9, 2016

(54) UTILITY CONSUMPTION DISAGGREGATION USING LOW SAMPLE RATE SMART METERS

(75) Inventors: Jing Dai, White Plains, NY (US); Feng Chen, Chappaqua, NY (US); Milind R. Naphade, Fishkill, NY (US); Sambit Sahu, Hopewell Junction, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 596 days.

(21) Appl. No.: 13/588,634

(22) Filed: Aug. 17, 2012

(65) Prior Publication Data

US 2013/0103215 A1 Apr. 25, 2013

Related U.S. Application Data

(60) Provisional application No. 61/525,310, filed on Aug. 19, 2011.

(51) Int. Cl.
*G06Q 50/06* (2012.01)

(52) U.S. Cl.
CPC ..... *G06Q 50/06* (2013.01)

(58) Field of Classification Search
CPC ..... G06Q 10/00; G06Q 10/04; G06Q 10/06; G06Q 10/06315; G06Q 50/06
See application file for complete search history.

(56) References Cited

U.S. PATENT DOCUMENTS 7,243,044 B2 * 7/2007 McCalla ..... G06Q 10/00 702/182
7,693,670 B2 4/2010 Durling
7,742,883 B2 * 6/2010 Dayton ..... G01F 15/0755 236/12.1
7,884,727 B2 * 2/2011 Tran ..... 340/573.1
2003/0023540 A2 * 1/2003 Johnson ..... G06Q 10/04 705/37
2003/0182310 A1 * 9/2003 Charnock et al. ..... 707/104.1
2006/0167784 A1 * 7/2006 Hoffberg ..... 705/37
2007/0087756 A1 * 4/2007 Hoffberg ..... 455/450
2007/0192825 A1 8/2007 Frank
2010/0289652 A1 * 11/2010 Javey et al. ..... 340/605
2010/0293045 A1 11/2010 Burns
2010/0317420 A1 * 12/2010 Hoffberg ..... 463/1
2011/0004421 A1 1/2011 Rosewell
2011/0046904 A1 * 2/2011 Souilmi ..... 702/62
2011/0066442 A1 3/2011 Ayachitula
2011/0153246 A1 * 6/2011 Donaldson et al. ..... 702/65

(Continued)

OTHER PUBLICATIONS

E. Larson et al., "Disaggregated water sensing from a single, pressure-based sensor: An extended analysis of HydroSense using staged experiments", Pervasive and Mobile Computing, Aug. 2010, pp. 1-21.*

(Continued)

*Primary Examiner* — Crystal J Barnes-Bullock
(74) *Attorney, Agent, or Firm* — Louis J Percello; Otterstedt, Ellenbogen & Kammer, LLP

(57) ABSTRACT

Utility meter readings generated at low sampling rates are disaggregated to identify consumer usage activities. Time intervals between readings can include a plurality of consumer usage activities. By employing a model which recognizes associations among consumer usage activities, effective disaggregation is possible using only aggregated consumption data and interval start times. Consumers and utility managers can design and assess conservation programs based on the disaggregated consumption usage activities.

15 Claims, 15 Drawing Sheets

(56) References Cited

U.S. PATENT DOCUMENTS

| | | | | |
|---|---|---|---|---|
| 2011/0282596 | A1* | 11/2011 | Patel | F23K 5/007 702/48 |
| 2011/0288905 | A1* | 11/2011 | Mrakas | G06Q 10/06 705/7.25 |
| 2011/0302125 | A1* | 12/2011 | Shetty et al. | 706/52 |
| 2012/0053472 | A1* | 3/2012 | Tran | 600/509 |
| 2012/0068692 | A1* | 3/2012 | Patel et al. | 324/202 |
| 2012/0101653 | A1* | 4/2012 | Tran | 700/296 |
| 2012/0215829 | A1* | 8/2012 | Naphade et al. | 709/203 |
| 2012/0278272 | A1* | 11/2012 | Kim et al. | 706/52 |
| 2012/0284790 | A1* | 11/2012 | Bhargava | 726/22 |
| 2013/0024029 | A1* | 1/2013 | Tran et al. | 700/278 |

OTHER PUBLICATIONS

Smart Water Meters Catch on in Iowa, downloaded from http://green.blogs.nytimes.com/2010/10/05/smart-water-meters-take-on-dubuque/?pagemo&_r=0 on Aug. 10, 2011, pp. 1-2.

Mario Berges et al. Learning Systems for Electric Consumption of Buildings. Proceedings of the 2009 ASCE International Workshop on Computing in Civil Engineering, Austin, Texas, pp. 1-10.

Mario E. Berges et al. Enhancing Electricity Audits in Residential Buildings with Nonintrusive Load Monitoring. Journal of Industrial Ecology,vol. 14, No. 5,2010, pp. 844-858.

James Fogarty et al. Sensing from the Basement: A Feasibility Study of Unobtrusive and Low-Cost Home Activity Recognition. UIST'06, Oct. 15-18, 2006, Montreux, Switzerland, pp. 1-10.

Younghun Kim, NAWMS: Nonintrusive Autonomous Water Monitoring System. SenSys'08, Nov. 5-7, 2008, pp. 1-13.

Jon Froehlich et al. HydroSense: Infrastructure-Mediated Single-Point Sensing of Whole-Home Water Activity. UbiComp 2009, Sep. 30-Oct. 3, 2009, pp. 1-10.

* cited by examiner

DISAGGREGATION FRAMEWORK

PILOT HOUSEHOLDS

SINGLE ADULT

TWO ADULTS

HOUSEHOLDS WITH KIDS

HOUSEHOLDS WITH TODDLERS

*FIG. 13*

| TERM | SYMBOL | DEFINITION |
|---|---|---|
| CONSUMPTION | CON | AMOUNT OF WATER USED IN TERMS OF GALLONS. |
| INTERVAL | INT | THE TIME PERIOD BETWEEN 2 CONSECUTIVE METER READINGS |
| ACTIVITY | $A$ | INTEGER VALUE THAT REPRESENTS ONE OF THE FOLLOWING APPLIANCES. E, A, C, B |
| EVENT | $E$ | A VECTOR OF FEATURES TO REPRESENT AN EVENT. THE EVENT FEATURES INCLUDE TOTAL CONSUMPTION, STATE/END TIME, etc. |
| EVENT SEQUENCE | $(E_1, \ldots, E_T)$ | A SEQUENCE OF EVENTS OCCURS IN A TIME WINDOW (e.g., 24 HOURS), WHERE $T$ IS THE NUMBER OF EVENTS. |
| PARALLEL ACTIVITIES | $(A_{t1}, \ldots, A_{ts})$ | $s$ ACTIVITIES OCCUR TOGETHER IN EVENT $E_t$ |
| EVENTS OF PARALLEL ACTIVITIES | $P(E^{(T)})$ | A SET OF EVENTS IN $(E_1, \ldots, E_T)$ GENERATED BY PARALLEL ACTIVITIES. |
| PARALLEL SUB-EVENTS | $(E_{t1}, \ldots, E_{ts})$ | A SET OF PARALLEL SUB-EVENTS WHOSE AGGREGATION GENERATES THE EVENT $E_t$. EACH SUB-EVENT $E_{ti}$ IS GENERATED BY A SINGLE ACTIVITY $A_{ti}$. |

*FIG. 14*

| FIXTURE | OCCURRENCES | TOTAL AMOUNT | PERCENTAGE |
|---|---|---|---|
| TYPE C-1 | 5 | 71 | 7% |
| TYPE C-2 | 5 | 57 | 6% |
| TYPE B | 9 | 366 | 38% |
| TYPE A-1 | 43 | 217 | 24% |
| TYPE A-2 | 33 | 68 | 7% |
| OTHERS (E AND UNLABELED) | N/A | 186 | 19% |

*FIG. 15*

| PRECISION, RECALL, F-MEASURE | TYPE A MEAN (STANDARD DEVIATION) | TYPE C MEAN (STANDARD DEVIATION) | TYPE B MEAN (STANDARD DEVIATION) |
|---|---|---|---|
| HMM | 0.7704 (0.08),<br>0.6651 (0.04),<br>0.7110 (0.04) | 0.9471 (0.04),<br>0.7883 (0.04),<br>0.8594 (0.03) | 0.7839 (0.06),<br>0.9610 (0.04),<br>0.8620 (0.04) |
| kNN-GMM | 0.7291 (0.07),<br>0.8552 (0.03),<br>**0.7850 (0.04)** | 0.9552 (0.02),<br>0.7723 (0.05),<br>0.8530 (0.03) | 0.8536 (0.06),<br>0.8937 (0.09),<br>0.8702 (0.06) |
| ANN-GMM | 0.5982 (0.05),<br>0.8709 (0.03),<br>0.7075 (0.04) | 0.9584 (0.03),<br>0.7670 (0.06),<br>0.8505 (0.04) | 0.8554 (0.08),<br>0.8994 (0.12),<br>0.8710 (0.09) |
| SVM-GMM | 0.4669 (0.07),<br>0.8873 (0.02),<br>0.6086 (0.06) | 0.9622 (0.02),<br>0.8057 (0.05),<br>**0.8761 (0.03)** | 0.8613 (0.06),<br>0.9329 (0.06),<br>**0.8940 (0.04)** |
| RANDOM PICK | 0.1022 (0.03),<br>0.0531 (0.01),<br>0.0699 (0.02) | 0.1514 (0.03),<br>0.1608 (0.04),<br>0.1560 (0.03) | 0.0737 (0.02),<br>0.3237 (0.10),<br>0.1201 (0.07) |
| KNAPSACK | 0.0655 (0.01),<br>0.1534 (0.02),<br>0.0918 (0.02) | 0.4570 (0.05),<br>0.3294 (0.05),<br>0.3828 (0.05) | 0.8619 (0.16),<br>0.3516 (0.13),<br>0.4995 (0.19) |

*FIG. 16*

| PRECISION, RECALL, F-MEASURE | TYPE A MEAN (STANDARD DEVIATION) | TYPE C MEAN (STANDARD DEVIATION) | TYPE B MEAN (STANDARD DEVIATION) |
|---|---|---|---|
| HMM | 0.516 (0.27),<br>0.597 (0.17),<br>**0.5536 (0.22)** | 0.831 (0.138),<br>0.818 (0.144),<br>**0.8244 (0.14)** | 1 (0),<br>1 (0),<br>**1 (0)** |
| RANDOM PICK | 0.20 (0.18),<br>0.19 (0.08),<br>0.1949 (0.13) | 0.08 (0.09),<br>0.19 (0.16),<br>0.1126 (0.17) | 0.07 (0.09),<br>0.29 (0.34),<br>0.1128 (0.27) |
| KNAPSACK | 0.20 (0.10),<br>0.904 (0.01),<br>0.3275 (0.05) | 0.52 (0.34),<br>0.47 (0.16),<br>0.4937 (0.25) | 0.44 (0.52),<br>0.23 (0.27),<br>0.3021 (0.39) |

UTILITY CONSUMPTION DISAGGREGATION USING LOW SAMPLE RATE SMART METERS

CROSS REFERENCE TO RELATED APPLICATION

This application claims the benefit of U.S. Provisional Application No. 61/525,310 filed on Aug. 19, 2011, the disclosure of which is incorporated by reference herein.

FIELD OF THE INVENTION

The present invention relates to activity analysis based on utility consumption, and more particularly to activity analysis based on low sample rate smart meters.

BACKGROUND OF THE INVENTION

Sustainability and design of sustainable technologies have become an important priority for cities given the unprecedented level of resource demand—water, energy, transit, healthcare, public safety—to most if not every service that makes a city attractive and desirable. At the same time, digital reification of the cyber-physical world has been possible with widespread penetration of sensing and monitoring technologies. These two important catalysts have fuelled significant interest and cross organizational collaboration among researchers, industries, urban planners, and government. Research has focused on leveraging information from such digital reification of cyber-physical world to help manage various services more efficiently.

Real-world deployments of smart meters are designed for utility billing and some basic analysis requirement, but many of them are not suitable for consumption disaggregation. Smart meters transmit consumption readings using wireless protocols, which consume battery and have dependency on physical environments. Although the meters can sample at a rate even higher than 1 MHz, many existing deployments have chosen to accumulate data at 15 min or even longer (1/900 Hz or longer) intervals to ensure reliable data transmission. However, physical environment may still affect the data transmission.

Research on disaggregating electricity or water load has been conducted on smart meter readings with fine granularity (mainly between 1 Hz~1 MHz). Existing approaches identify appliances/fixtures based on analyzing steady state or transient state change in real-time consumption.

SUMMARY OF THE INVENTION

Principles of the invention provide systems and techniques for effective utility consumption disaggregation. Such disaggregation may allow consumers to implement conservation techniques, thereby saving money, conserving resources and/or helping to protect the environment. In one aspect, an exemplary method includes the steps of obtaining an activity sequence model correlating utility consumption patterns with particular utility consumption activities, transmitting aggregated utility consumption data from a utility meter at time intervals, obtaining a sequence of the aggregated utility consumption data collected at the time intervals, and disaggregating the sequence of aggregated utility consumption data into consumption activities using the activity sequence model.

In another aspect, an exemplary system includes an information receiving device configured to receive sequences of aggregated utility interval consumption data; a storage device for electronically storing the received sequences of aggregated utility consumption data; a storage device comprising an activity sequence model correlating utility consumption patterns with particular utility consumption activities, and a processing device configured to disaggregate the sequences of aggregated utility consumption data into utility consumption activities by applying the activity sequence model to the received sequences of aggregated utility consumption data.

In a further aspect, a computer program product is provided that includes a computer readable storage medium having computer readable program code embodied therewith. The computer readable program code is configured to obtain a sequence of aggregated interval consumption, generate events from the sequence of aggregated interval consumption where each event represents one utility consumption activity or parallel utility consumption activities, apply an activity sequence model correlating utility consumption patterns with particular utility consumption activities to obtain anomalous events and detect parallel utility consumption activities from the anomalous events, estimate the number of parallel consumption activities for each anomalous event, estimate hidden parallel consumption activities, and estimate consumption associated with the hidden parallel consumption activities.

As used herein, "facilitating" an action includes performing the action, making the action easier, helping to carry the action out, or causing the action to be performed. Thus, by way of example and not limitation, instructions executing on one processor might facilitate an action carried out by instructions executing on a remote processor, by sending appropriate data or commands to cause or aid the action to be performed. For the avoidance of doubt, where an actor facilitates an action by other than performing the action, the action is nevertheless performed by some entity or combination of entities.

One or more embodiments of the invention or elements thereof can be implemented in the form of a computer program product including a tangible computer readable recordable storage medium with computer usable program code for performing the method steps indicated. Furthermore, one or more embodiments of the invention or elements thereof can be implemented in the form of a system (or apparatus) including a memory, and at least one processor that is coupled to the memory and operative to perform exemplary method steps. Yet further, in another aspect, one or more embodiments of the invention or elements thereof can be implemented in the form of means for carrying out one or more of the method steps described herein; the means can include (i) hardware module(s), (ii) software module(s), or (iii) a combination of hardware and software modules; any of (i)-(iii) implement the specific techniques set forth herein, and the software modules are stored in a tangible computer-readable recordable storage medium (or multiple such media).

Techniques of the present invention can provide substantial beneficial technical effects. For example, one or more embodiments may provide one or more of the following advantages:

- Disaggregation of utility consumption data using low sample rates;
- Utility waste and inefficient use can be identified;
- Pertinent activity patterns can be discovered for understanding behavior and detecting anomalies;
- Sufficient data for disaggregation is provided by utility meters having minimal features.

These and other features and advantages of the present invention will become apparent from the following detailed description of illustrative embodiments thereof, which is to be read in connection with the accompanying drawings.

BRIEF DESCRIPTION OF THE DRAWINGS

FIG. 13 summarizes terms and definitions;

FIG. 14 is a table of exemplary water journaling of one household;

FIG. 15 is a table of exemplary Precision, Recall, and F-measure on Simulation Data;

FIG. 16 is a table of exemplary Precision, Recall, and F-measure on Volunteers;

DETAILED DESCRIPTION OF PREFERRED EMBODIMENTS

Consumption activities disaggregated from meter readings may empower residents with appropriate insights to influence and shape their behavior. In addition, from disaggregated consumption, utility managers can design and assess conservation programs and prioritize energy-saving potential retrofits. A novel statistical framework is provided for disaggregation on coarse granular smart meter readings by modeling fixture characteristics, household behavior, and activity correlations.

Figure 1:
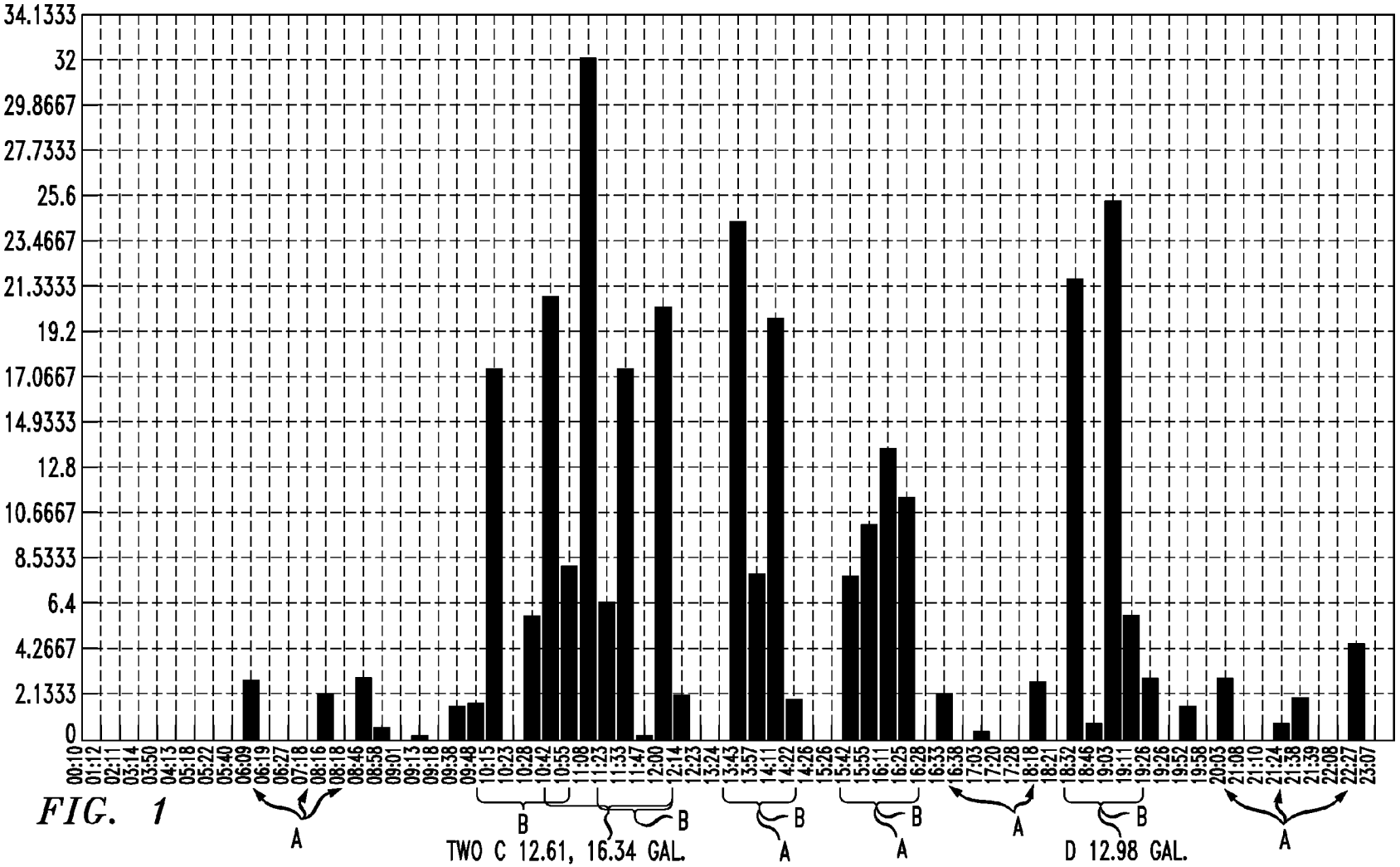
FIG. 1 is a chart showing water meter data and expected disaggregated activities.

Consumption disaggregation as discussed herein addresses various conditions such as 1) parallel usage activities, e.g., a type A and C usages (see below) in the same 15 minute interval, 2) difficulty of aligning usage events temporally, e.g., a Type C use may appear in one or two intervals, 3) lack of features, i.e., only aggregated consumption and start time of each interval can be used to identify usage activity. An example of such water meter data and expected disaggregated activities is illustrated in FIG. 1. It is to be emphasized that embodiments of the invention may be applicable in a variety of resource utilization and/or consumption scenarios, residential and/or industrial, and that the example water consumption events are non-limiting, as are the example water-consuming appliances. For example, in general, in the figures and text:

- a Type A usage could be the flushing, and a Type A appliance (appliance also referred to as a fixture herein) could be a water closet;
- a Type B usage could be clothes washing, and a Type B appliance could be a washing machine;
- a Type C usage could be showering, and a Type C fixture could be a shower;
- a Type D usage could be the use of a dishwasher, and a Type D appliance could be a dishwasher;
- a Type E usage could be the use of a sink, and a Type E fixture could be a sink To handle these challenges, a novel statistical framework is provided for activity analysis on coarse granular smart water meter readings, and deployed as a component in a system that promotes smarter water usage. In this framework, fixture characteristics, household behavior, and activity correlations are utilized to disaggregate consumption. To implement this framework, two approaches are provided to identify activities. The first approach applies hidden Markov model (HMM) to capture the relationship among consumption events and hidden activities. The second approach utilizes classification techniques to learn from labeled activities, and a Gaussian mixture model is used for disaggregation. The proposed approaches have been validated using both real-world water consumption and synthetic datasets. Technical advantages of the invention include:

- Providing activity-level consumption insights to residents and city management teams to support decision making;
- Designing a general disaggregation framework with two implementations for different scenarios;
- Exploring appropriate smart meter sample rate to enable consumption disaggregation;
- Revealing consumption patterns from the disaggregation results.

The application deployment for the proposed approach is discussed first below with reference to FIGS. 2 and 3.

Figure 2:
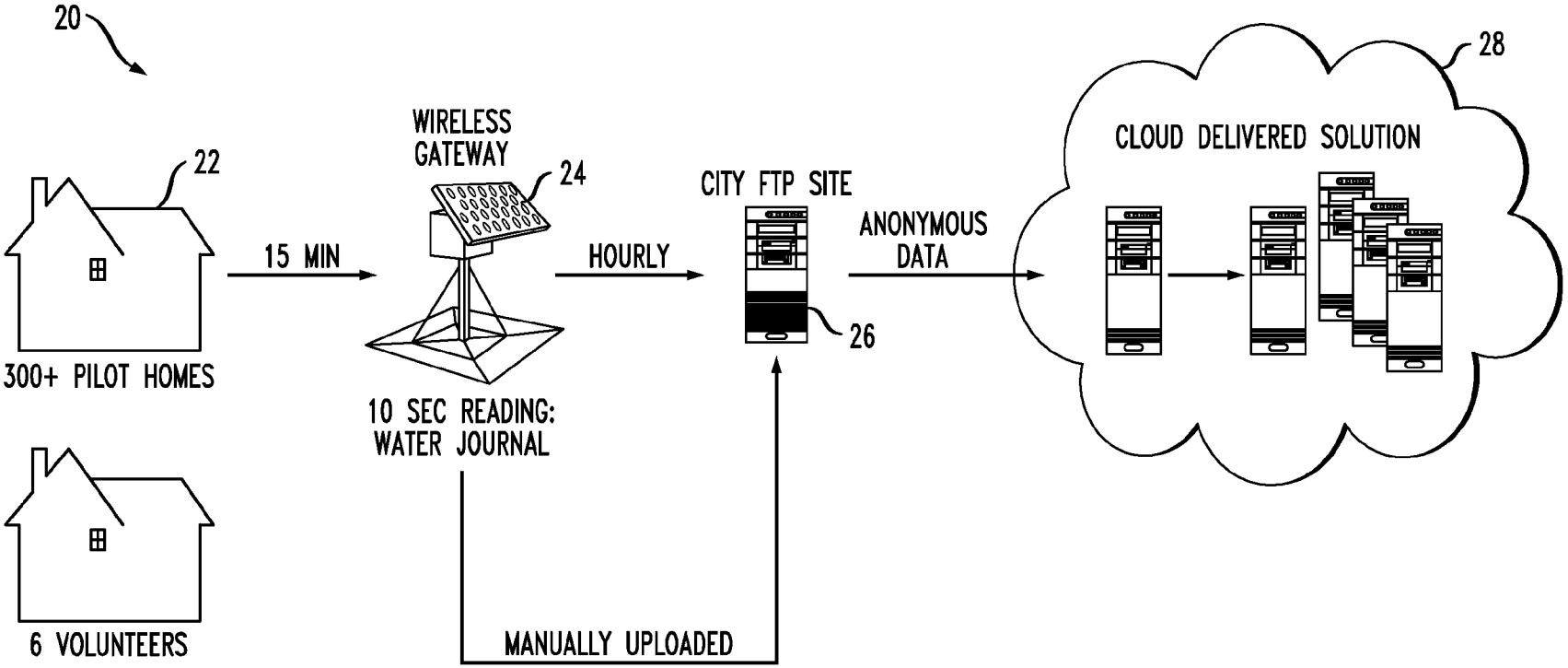
FIG. 2 is a schematic illustration of a smart water meter infrastructure for gathering data.

The deployed environment of an exemplary smart water meter infrastructure 20 is shown in FIG. 2. Households 22 include, in this exemplary embodiment, commercially available Neptune R900 smart water meters with UFR (Unmeasured Flow Reducer), which transmit a new aggregated reading roughly every 15 minutes through a 900 MHz wireless connection. Such meters are available from Neptune Technology Group, Inc. Each aggregated reading is broadcasted repeatedly within the entire interval to ensure the success of transmission. Wireless gateways 24 are deployed to collect these readings, attach timestamps, and send the readings to a data center (e.g. an FTP site 26) through a 3G network every hour. In addition, in this exemplary infrastructure, a second group of households 22' have applied data logger which records water consumption every 10 seconds, and had done water usage activity journaling accordingly for a week. All the meter readings are transmitted to a computing cloud 28 for analytics. It will be appreciated that smart meters made by other manufacturers may be suitable for purposes of the invention and that any required computing may be performed using computing devices known to those of ordinary skill in the art.

Figure 3:
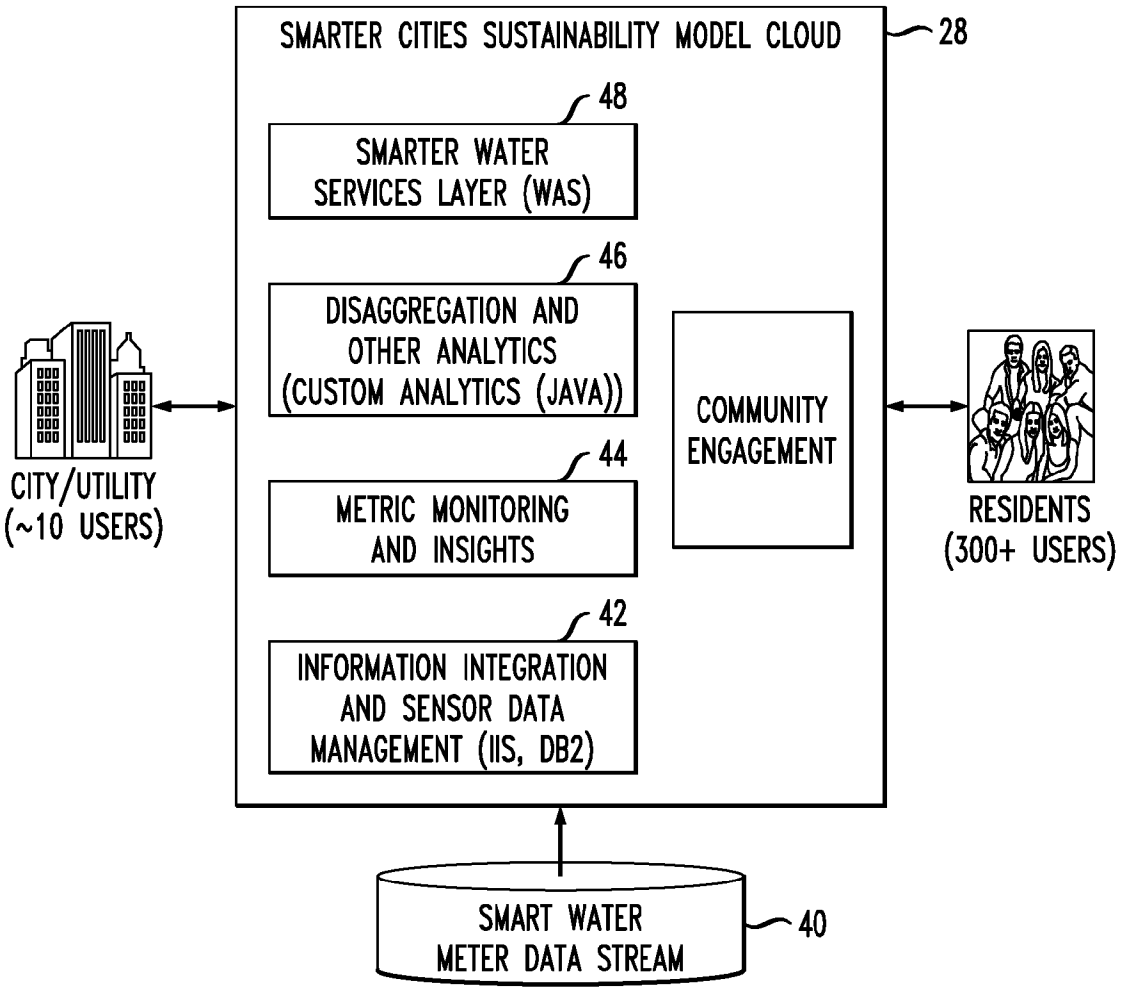
FIG. 3 shows a software architecture for the infrastructure of FIG. 2.

The software architecture of an exemplary system is provided in FIG. 3. The data stream 40 generated by the smart meters is received by an information server platform 42, such as InfoSphere Information Server®(IIS), and then electronically stored in a database. On top of this database, software 44 such as Cognos®, available from International Business Machines, is utilized to provide online analytical processing (OLAP) functions such as consumption metric and pattern monitoring. A java-based module 46 is developed to perform advanced analytics functions such as disaggregation and prediction. An application server 48 such as an IBM WebSphere Application Server® (WAS) hosts the service layer to allow user interaction with the services.

An objective of the system disclosed herein is to provide effective services that can help the residents and/or commercial consumers to modify their behavior to be more sustainable. In other words, consumers can be advised what they need to know to change their behavior. To achieve that goal, one important process is to reveal disaggregated water consumption, so that the users can know where in their houses (or businesses) they could conserve water, and sustainable operations or investment can be suggested. Activity-level consumption distribution reports can be distributed every month from fifteen-minute aggregated consumption data.

Disaggregation from coarse granular smart water meter readings, such as those described above, can be informally described as follows. Given a sequence of aggregated interval water consumption $Con^{(T)}=(Con_1, \ldots, Con_T)$, where $Con_i$ refers to the aggregated water consumption at the i-th time interval, the proposed solution should return a set of activities $(A_1, E_1), \ldots, (A_k, E_k)$ that are most likely to cause the aggregated consumption $Con^{(T)}$, where $A_i$ refers to an activity state (e.g., type A, B or C uses), and $E_i$ refers to an observation (event) of water consumption for this activity state and is represented by a vector of event features, including total water consumption and start/end time intervals.

The related terms and their definitions are summarized in the table of FIG. 13. Capital letters are employed in the table to denote random variables and small case letters denote observations.

General challenges for usage disaggregation from a single main meter include the following: 1) appliances/fixtures with similar consumption patterns, e.g., certain Type E usage and a type A usage; 2) appliances/fixtures with multiple settings, e.g., normal, dedicated, and permanent of a Type B appliance; 3) load variation, e.g., low, medium, and full load of a washer, or length of showers; 4) multiple cycles, e.g., washer and dishwasher; 5) lack of real-world ground truth, i.e., hard to collect sufficient labeled data from consumers. Disaggregation with the above challenges can be treated as a real-world classification problem.

In addition, the specific application scenario discussed above brings further challenges because of the coarse granularity and unstable reading intervals caused by unreliable communication. These limitations cause: 1) parallel usage activities, e.g., two type A uses and a Type C use in the same 15 minute interval, 2) difficulty of aligning usage events temporally, e.g., a Type C use may appear in one or two intervals, 3) lack of features, i.e., only aggregated consumption and start time of each interval can be used to identify usage activity. These specific challenges make the task of water usage disaggregation more than a classification problem and difficult to solve. Existing disaggregation approaches focus on analyzing steady state or transient state changes. They cannot handle the specific challenges in the above scenario because no steady state or transient state can be detected with such a low sample rate.

Due to the challenges discussed, the aggregated consumption of each interval alone cannot provide confident disaggregation results. Facts on what other factors may help improve the disaggregation accuracy are accordingly investigated. After a study over the activity journaling from the volunteer group of households 22', three useful characteristics of water usage activities have been identified: fixture-dependent, household-dependent, and time-dependent.

Fixture-Dependent Patterns

Each fixture/appliance category has its own usage pattern in terms of consumption and duration that can be used to distinguish it from the others. Specifically, the amount of water consumed in a type A use usually falls in several small ranges between 1.5~5 gallons, and is consistent for a specific type A fixture. A type B use generally lasts between 30~60 minutes, and consists of multiple cycles with similar water usage. Type C uses have consistent flow rates most of the time and last from five minutes to fifteen minutes in most cases. Type E usage is usually short in time and low in consumption. These patterns can help briefly categorize the usage events. For example, any interval with flow rate lower than 0.1 gallons per 15 minutes can be filtered out as Type E usage. However, using a fixture specification library is not enough to identify parallel activities, or to deliver customized models for each household.

Household-Dependent Patterns

Activity patterns heavily depend on the fixture models and occupants of a specific household. For example, households with children generally spend more time using Type C fixtures every day; households with open leaks showed continuous usage for a long time; some households have three type A fixtures, each having a different specification. Therefore, each household is preferably modeled separately to ensure accurate disaggregation. These models can be learned from historical consumption records and household profiles if available.

Time-Dependent Patterns

Some activities may happen frequently during specific time periods, which can be used to distinguish water usage. One example of such a pattern is Type C usage. Most Type C use happens either close to the first event of usage in the morning or close to the first event after work. Although type A use occurred almost any time in a day, it was less frequent in working hours and mid-night than the rest of the day. In addition to time of day, the day of the week has also been found to have impacts on activity patterns. An example could be Type B usage, which happens mostly during weekends in some households. In addition, some activities are found temporally associated. For instance, a type A use in many cases was followed by a short Type E usage. According to the time-dependent activity patterns, timestamps of usage events should be able to improve disaggregation results significantly.

Figure 4:
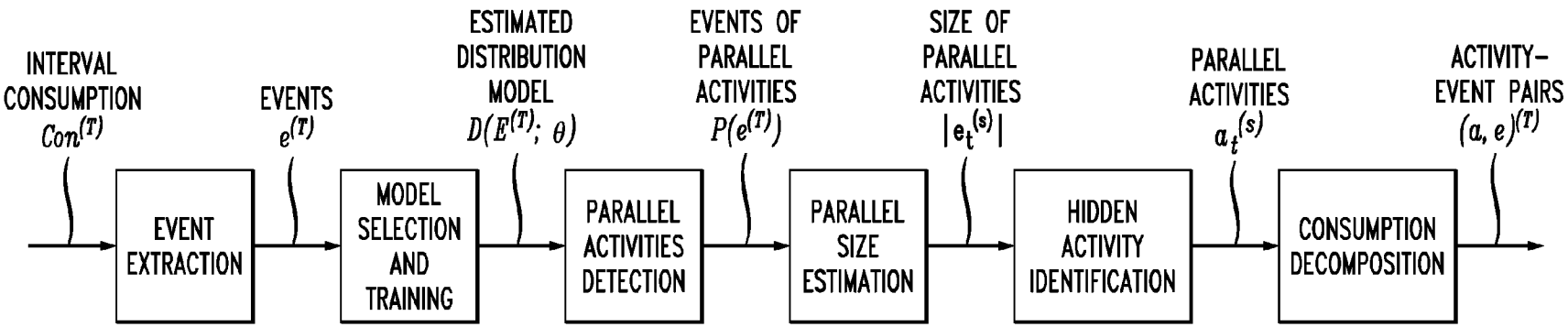
FIG. 4 is a flow chart showing a disaggregation framework.

Coarse granular smart meter readings tend to include a large portion of parallel activities, and disaggregation of parallel activities is accordingly an important challenge. The invention provides a General Disaggregation Framework (GDF) to address the disaggregation problem. As illustrated in FIG. 4, the GDF framework applies six phases to disaggregate water consumption. The work flow is described as follows:

Phase 1 Event Extraction:

Given a sequence of aggregated interval consumption $Con^{(T)}=(Con_1, \ldots, Con_T)$, the intervals with continuous consumption are grouped to generate events where each represents one activity or parallel activities. The output of this phase is an event observation sequence of a given time window: $e^{(T)}=(e_1, e_2, \ldots, e_T)$. Hence, $e^{(T)}$ is regarded as one observation of the event random variables $E^{(T)}=(E_1, E_2, \ldots, E_T)$. Each event $E_i$ may be generated by a hidden activity $(A_i)$ or several parallel hidden activities $(A_{i1}, \ldots A_{is})$. Observed utility (e.g. water or electricity) consumption is due to certain activities (for example, activities of people or of an industrial enterprise). The derived activities that relate to the consumption observations are referred to as the related hidden activities.

Phase 2 Model Selection and Training:

Select an appropriate stochastic model $D(E^{(T)}; \theta)$, such as HMM or GMM, and estimate parameters $\theta$ based on historical labeled or unlabeled observations.

Phase 3 Parallel Activity Detection:

Given the estimated stochastic model $D(E^{(T)}; \theta)$, the events with parallel activities $P(e^{(T)})$ can be identified from anomalous events $O(e^{(T)})$. Anomalous events can be obtained using a leave-one-out test, i.e., $O(e^{(T)})=\{e_t|e_t \epsilon R\ (E^{(-t)}=e^{-1}, \alpha)\}$, where $E^{(-t)}=(E_1, \ldots, E_{t-1}, E_{t+1}, \ldots, E_T)$, $e^{(-t)}=(e_1, \ldots, e_{t-1}, e_{t+1}, \ldots, e_T)$. R(.) refers to the outlying region of normal event $E_t$ that is defined based on the conditional distribution of $[E_t|E^{(-t)}=e^{(-t)}]$ and a confidence level a (e.g., 0.99). The calculation of outlying regions based on HMM and GMM models will be discussed below. This phase assumes all anomalous events are generated due to parallel activities. An anomalous event may also be generated by true abnormal activities such as a shower lasting more than an hour. However, it is difficult to differentiate these only based on coarse granular meter readings. Hence, only consider parallel activities are considered.

Phase 4 Parallel Size Estimation:

For each anomalous event observation $e_t \epsilon O(e^{(T)})$, the number of parallel activities that generate $e_t$ can be estimated by:

$$s=\min\{s|e_t \epsilon R^{-}_{Agg}(E^{(-t)}=e^{(-t)}, \mathrm{Agg}(E_{t1}, \ldots, E_{ts}), \alpha)\} \quad (1)$$

where $\{E_{t1}, \ldots, E_{ts}\}$ refers to the parallel activities (random variables) whose aggregation generates the event $e_t$, Agg(.) refers to the vector of aggregated features, and $R^{-}_{Agg}(.)$ refers to the normal region of the aggregated features $\mathrm{Agg}(E_{t1}, \ldots, E_{ts})$. $\mathrm{Agg}(E_{t1}, \ldots, E_{ts})$ returns aggregated features, such as the total water consumption, the earliest start time, and the latest end time of the sub-events $\{E_{t1}, \ldots, E_{ts}\}$. The reason of selecting the minimal s is that heavy consumption (a washer load) can always be decomposed into a large number of small activities (e.g., type A uses), which is not reasonable.

Phase 5 Hidden Activity Identification:

An abnormal event refers to a consumption event that is very unlikely to occur due to normal behavior. For example, the use of more than ninety gallons of water between 6 PM and 7 PM is considered abnormal for most households. A single activity normally will not consume such a large volume of water. When this situation is detected, the abnormal event is likely caused by the occurrence of parallel activities, such as concurrent Type B, C and E use. For each abnormal event $E_t \epsilon O(E^T)$, given s, the estimated size of parallel activities, this phase estimates the disaggregated activities $(a_{t1}, \ldots, a_{ts})$:

$$(a_{t1}, \ldots, a_{ts})=\arg_{(at1, \ldots, ats)\epsilon\{1, \ldots, m\}^s}\max Pr(A_{t1}=a_{t1}, \ldots, A_{ts}=a_{ts}|E^{(-t)}=e^{(-t)}, \mathrm{Agg}(E_{t1}, \ldots, E_{ts})=e_t), \quad (2)$$

where m is the total number of activity types (e.g., shower, washer).

Phase 6 Consumption Decomposition:

Given the hidden parallel activities $\{a_{t1}, \ldots, a_{ts}\}$ estimated in Phase 5, the related water consumption of these hidden activities can be estimated as:

$$(\mathrm{Con}(e_{t1}), \ldots, \mathrm{Con}(e_{ts}))=\arg_{Con(e_{t1}, \ldots, Con(e_{ts})}\max L(\mathrm{Con}(E_{t1})=\mathrm{Con}(e_{t1}), \ldots, \mathrm{Con}(E_{ts})=\mathrm{Con}(e_{ts})| E^{(-t)}=e^{(-t)}, A_{t1}=a_{t1}, \ldots, A_{tm}=a_s, \mathrm{Agg}(E_{t1}, \ldots E_{ts})=e_t), \quad (3)$$

where L is the likelihood function, and $\mathrm{Con}(e_{ti})$ is the consumption feature of the sub-event observation $e_{ti}$, i=1, . . . , s.

To evaluate the correctness of GDF, the following theorem is presented:

Given a sequence of aggregated consumption intervals $\mathrm{Con}^{(T)}=(\mathrm{Con}_1, \ldots, \mathrm{Con}_T)$, GDF is able to identify true hidden activities $((A_1,E_1), \ldots, (A_k,E_k))$ of $\mathrm{Con}^{(T)}$, if the following assumptions are satisfied: a) In Phase 1, the events can be correctly identified and the features extracted are sufficient; b) the distribution $D(E^{(T)};\theta)$ is correctly selected and estimated; c) all anomalous events are due to parallel activities; d) the minimal s selected in Phase 4 is correct.

The four conditions stated above assure that the built statistical model by GDF is consistent with the true distribution of hidden activities of $\mathrm{Con}^{(T)}$. It follows that the activities identified by GDF are the most probable results and should be consistent with true hidden activities.

Two approaches based on GDF are disclosed herein for handling different disaggregation scenarios. When there is no sufficient training data available, which is true in many real-world scenarios, one proposed approach is to learn hidden relationships among consumption events and activities without user input based on hidden Markov model (HMM). When labeled activities are available for training, a second approach is designed to construct statistical models using classification techniques and disaggregate parallel activities using a Gaussian mixture model (GMM).

HMM-Based Approach

An implementation of GDF based on HMM can be employed in accordance with the invention. It is trained based on unlabeled data and performs disaggregation without user input. For the purpose of simplicity, each event $E_i$ is represented by a single feature, the total water consumption. Other features, such as start/end time intervals and duration can be included in this approach in a straightforward manner.

Event Extraction (GDF Phase 1)

A key challenge of event extraction is the segmentation process. Without labeled historical data, it is necessary to define a set of heuristic rules to generate meaningful events based on domain knowledge. The basic criterion is to keep adjacent interval consumption in a single event if they possibly relate to one activity or parallel activities. This is to avoid the situation where one activity is divided into two separate events, which is not recoverable in the present approach. If two nonparallel activities are mistakenly grouped to one event, they can still be identified in the consequent disaggregation process.

Similar to the idea of hierarchical clustering, a bottom-up based segmentation algorithm is proposed as follows:

Step 1: Preprocessing. Remove leaking effects, and filter out all zero-consumption intervals.

Step 2: Initialization. Regard each left interval as one event. Then we have the sequence of initial events $(e_1, \ldots, e_k)$, where k is the number of nonzero consumption intervals.

Step 3: Merging heavy events. Define a water consumption threshold $\theta$ (e.g., 5.5 gallons for 15-minute-size intervals). For each continuous event pair $(e_i, e_{i+1})$, if $\mathrm{Con}(e_i)>\theta$ and $\mathrm{Con}(e_{i+1})>\theta$ merge $e_i$ and $e_{i+1}$. Repeat until no such pair exists.

Step 4: Merging light events. For each event $e_i$ with $\mathrm{Con}(e_i)>\theta$, if $0<\mathrm{Con}(e_{i-1})$, then merge $e_i$ and $e_{i-1}$. Similarly, if $0<\mathrm{Con}(e_{i+1})$, then merge $e_i$ and $e_{i+1}$. If there is an event $e_i$ with $0<\mathrm{Con}(e_i)$, and both $\mathrm{Con}(e_{i-1})$ and $\mathrm{Con}(e_{i+1})$ greater than $\theta$, then $e_i$ is merged to the segment with the smallest consumption.

Step 5: Merging peak events. Merge two peak events $(\mathrm{Con}(e_i),\mathrm{Con}(e_j)))$ if $\mathrm{dist}(e_i,e_j)\leq\tau$, where $\mathrm{dist}(e_i,e_j)=t_{start}(e_j)-t_{end}(e_i)$, and $t_{start(.)}$ and $t_{end(.)}$ refer to the start and end time of an event respectively. An event is defined as a peak if its total water consumption is greater than a threshold $\gamma$ (e.g., 20 gallons). This step is specifically designed for fixtures like Type B appliances, which consists of multiple peaks with more than 15 minutes empty cycle (no water consumption) between peaks.

HMM Parameter Estimation (GDF Phase 2)

A hidden Markov model is usually trained based on an EM (expectation-maximization) algorithm, which can only guarantee local optimum. Given a large number of parameters to be estimated in a HMM model, including the number of hidden states, the initial probabilities, the emission distribution of each state, and the transition matrix, it is important to find appropriate initial settings for these parameters. By empirical evaluation, a mixture model of three Gaussians for Type E events and Gaussian models for other activity events is chosen. A heuristic based approach is presented herein to seek initial settings for each household based on generic domain knowledge:

Step 1: Type A fixture identification. Hierarchical clustering is applied on events to identify type A fixture clusters. By domain knowledge, type A fixture clusters could be identified by requiring the cluster size to be greater than three (3) times the total number of days in the training data, and the consumption standard deviation smaller than 0.5 gallons.

Step 2: Type E identification. Type E events can be identified as the events with consumption lower than $(u_i-2*\sigma_i)$, where $u_i$ and $\sigma_i$ are the mean and standard deviation of the type A fixture cluster with the smallest mean consumption in all type A fixture clusters.

Step 3: Frequent pattern identification. After removing Type F events and type A fixture clusters, hierarchical clustering is applied on the remaining events to identify other qualified clusters. In order to control the HMM complexity, only the twelve (12) clusters with the smallest standard deviation are kept.

Step 4: Cluster labeling. This step gives labels to the qualified clusters based on predefined rules such as a Type C usage should be within 5~25 gallons. If some clusters are still not labeled, these clusters are labeled as "others", which may relate to some unknown activity state or frequent combination of parallel activities.

Step 5: Anomaly removal. The anomalous events are identified based on a Gaussian mixture distribution estimated from qualified clusters. These outliers will impact the training of HMM; therefore they are removed from training data.

Step 6: Probability estimation. Regarding each qualified cluster as a hidden state, the number of hidden states, the mean and standard deviation of each hidden state can be obtained. The transition matrix and initial probabilities can be estimated based on labeled events.

Disaggregation and Labeling (GDF Phases 3-6) First, several notations are defined as follows. The set of activity states is $\{1, \ldots, m\}$, D is an m by m transition matrix, $\pi$ is the initial probability of the m states, $p_i(e_t)=Pr(E_t=e_t|A_t=i)$, and $u_i(t)=Pr(A_t=i)$. For the purpose of simplicity, it is assumed that each event $E_t$ conditioned on activity state $A_t$ follows a Gaussian distribution $[Et|At=i]\sim\mathcal{N}(u_i, \sigma_i^2)$. Note that the following derivations can also be straightforwardly extended to Gaussian mixture distributions.

$$\text{Let } P(e) = \begin{bmatrix} p_1(e) & 0 & 0 \\ 0 & \ldots & 0 \\ 0 & 0 & p_s(e) \end{bmatrix} \in \mathbb{R}^{s\times s},$$

$$\alpha_t = Pr(e_1, \ldots, e_t, A_t) \in \mathbb{R}^s,$$

$$\alpha_t(a_t) = \alpha_t = Pr(e_1, \ldots, e_t, A_t = a_t) \in \mathbb{R},$$

$$\beta_t = Pr(e_{t+1}, \ldots, e_T \mid A_t) \in \mathbb{R}^s,$$

$$\beta_t(a_t) = Pr(e_{t+1}, \ldots, e_T \mid A_t = a_t) \in \mathbb{R}, \text{ and } B_t = DP(e_t)..$$

The HMM implementations of GDF Phase 3 to 6 are as follows:

GDF Phase 3: Parallel Activity Detection

The probability density function $$P(E_t = e \mid E^{(-t)} = e^{(-t)}) = \frac{\alpha_{t-1}^T DP(e)\beta_t}{\alpha_{t-1}^T D\beta_t} = \sum_i w_i(t)p_i(e) \text{ where}$$

$$w_i(t) = \frac{d_i(t)}{\sum_{j=1}^m d_j(t)},\ d_i(t) = [\alpha_{t-1}^T D]_i[\beta_t]_i.$$

It indicates that $$[E_t=e|E^{(t)}=e^{(-1)}]$$

follows a GMM:

$$[E_t=e|E^{(-t)}=e^{(-t)}]\sim\Sigma_i w_i(t)\mathcal{N}(x|\mu_i,\sigma_i^2)$$

The outlying region of the GMM model can be calculated as $$R(e^{(-t)}, \alpha) = \left\{e \,\middle|\, |e-\mu_{k^*}| > \sigma_{k^*}\Phi^{-1}\left(\frac{1-\alpha}{2}\right)\right\},$$

where k* is the Gaussian component closest to e, and $\phi(.)$ is the cumulative density function (CDF) of a standard Gaussian distribution. Here it is assumed that the statistics of outlying events are dominated by the component closest to the observation. This outlying region estimation has been justified in published literature using extreme value statistics, namely S. J. Roberts, "Novelty Detection using Extreme Value Statistics", IEE-VISP, vol. 146, pp 124-129 (June 1999).

GDF Phase 4: Parallel Size Estimation

The probability density function $$P(E_{t1} = e_{t1}, \ldots, E_{ts} = e_{ts} \mid e^{(-t)}) = \frac{\alpha_{t-1}^T \prod_{i=1}^s \{DP(e_{ti})\}\beta_t}{\alpha_{t-1}^T D^s \beta_t} = \sum_{(l_1,\ldots,l_s)\in\{1,\ldots,m\}^s} w_{l_1,\ldots,l_s} P_{l_1}(e_{t1}) \ldots P_{l_m}(e_{ts}),$$

where $$w_{l_1,\ldots,l_m}$$

is the weight that can be calculated based on the form $$\left\{\alpha_{t-1}^T \cdot \prod_{i=1}^s \{DP(e_{ti})\} \cdot \beta_t\right\}\alpha_{t-1}^T D^s \beta_t.$$

It implies that $$[E_{t1}, \ldots, E_{ts} \mid E^{(-t)} = e^{(-t)}] \sim \sum_{(l_1,\ldots,l_s)\in\{1,\ldots,m\}^s} w_{l_1,\ldots,l_s}\mathcal{N}\left(\left[\mu_{l_1},\ldots,\mu_{l_s}\right]^T, \operatorname{diag}\left(\sigma_{l_1}^2, \ldots, \sigma_{l_s}^2\right)\right)$$

By linear transformation, we have that $$[E_{t1}+\ldots+E_{ts}\mid E^{(-t)}=e^{(-t)}]\sim\sum_{(l_1,\ldots,l_s)\in\{1,\ldots,m\}^s} w_{l_1,\ldots,l_s}\mathcal{N}\left(\sum_{k=1}^{s}\mu_{l_i},\sum_{k=1}^{s}\sigma_{l_i}^2\right).$$

Note that here $Agg(E_{tl},\ldots,E_{tm})=E_{tl}+\ldots+E_{ts}$. Since $$[Agg(E_{t1},\ldots,E_{tm})\mid E^{(-t)}=e^{(-t)}]$$

follows a Gaussian mixture distribution, the normal region $R_{Agg}^{-}(\bullet)$ can be estimated similarly as in the above GDF Phase 3.

GDF Phase 5: Hidden Activity Identification

The probability density function $$Pr(A_{t1}=a_{t1},\ldots,A_{ts}=a_{ts}\mid E^{(-t)}=e^{(-t)},E_{t1}+\ldots+E_{ts}=e_t)=\frac{\alpha_{t1}(a_{t1})\prod_{i=1}^{s-1}Pr(a_{t(i+1)}\mid a_{ti})Pr\left(\sum_k E_{tk}=e_t\mid a_{t1},\ldots,a_{ts}\right)\beta_{ts}(a_{ts})}{L_T},$$

where $L_T$ is the likelihood of the whole sequence and can be neglected when solving the problem (2). It should be noted that the random variables $E_{t1},\ldots,E_{ts}$ are independent to each other given their hidden activity states $A_{t1},\ldots,A_{ts}$. The probability density function $Pr(\Sigma_k E_{tk}=e_t|a_{t1},\ldots,a_{ts})$ can be calculated by simple linear transformation of independent Gaussian random variables.

GDF Phase 6: Consumption Decomposition

Given the hidden activity states $\{a_{t1},\ldots,a_{ts}\}$, we have that $$[E_{t1},\ldots,E_{ts}|a_{t1},\ldots,a_{ts}]\sim\mathcal{N}(\mu,\Sigma),$$

where $\mu=[\mu_{a_{t1}},\ldots,\mu_{a_{ts}}]^T$, $\Sigma=\mathrm{diag}(\sigma_{a_{t1}},\ldots,\sigma_{a_{ts}})$. The optimal solution of where) the problem (3) can be obtained in a manner known to those of ordinary skill in the art. H. Rue, "Fast Sampling of Gaussian Markov Random Fields," JRSS: Series B, vol. 63, pp. 325-338 (2001) includes an exemplary discussion of such problem solving.

$$[e_{t1},\ldots,e_{ts}]^T=\mu-\Sigma^{-1}1^T(1^T\Sigma 1)^{-1}(1^T\mu-e_t).$$

Classification-GMM-Based Approach

Different from the HMM-based approach, a mixed model approach to the disaggregation problem is disclosed that requires labeled data for training. It first applies a classification model (e.g., support vector machine, neural network, and k-nearest neighbor classifier) to classify each event as a single activity, or a known frequent combination of parallel activities, or an unknown infrequent combination of parallel activities. For the events classified to the last category (unknown infrequent combinations), it applies an implementation of the GDF framework based on GMM to disaggregate parallel activities.

It is assumed that a sequence is given of aggregated interval consumption $Con^{(T1)}=(Con^*_1,\ldots,Con^*_{T1})$ and the related hidden activities $((a_1^*,e_1^*),\ldots,(a_k^*,e_k^*))$ as the labeled training data. The objective is to build a model on $Con^{(T1)}$ that can identify unknown hidden activities $((a_1,e_1),\ldots,(a_k,e_k))$ of a new aggregated intervals consumption sequence $Con^{(T)}=(Con_1,\ldots,Con_T)$.

Event Extraction (GDF Phase 1)

This phase first applies the same procedure as described above for the HMM-based approach to identify a sequence of events. Here each $e_i$ has six features, which include the start time, duration, total consumption, minimal interval consumption, maximal interval consumption, and number of peaks.

Classification (GDF Phase 2)

The event extraction phase returns an event sequence $(e_1,\ldots,e_k)$, where each $e_i$ is represented by a vector of six features ($e_i\in\mathbb{R}^6$). Note that all the features are mapped to real type values, in order to apply classification models such as SVM and neural network.

Here, we neglect the dependencies between events and treat $(e_1,\ldots,e_k)$ as a set of independent training instances: $\{e_1,\ldots,e_k\}$. Based on the labels $((a_1^*,e_1^*),\ldots,(a_k^*,e_k^*))$, it is able to identify hidden activities of each event $e_i$. To decide class labels, not only single activities (e.g., types A, B and C) are treated as distinct classes, but also frequent combinations of parallel activities are regarded as distinct classes. The current setting is that frequent parallel activities should occur at least once per week.

GMM-Based Disaggregation (GDF Phase 3-6)

After the classification process, each event has been labeled as a single activity, or known/unknown combination of parallel activities. For parallel activities, a GMM-based implementation of the GDF framework is proposed to disaggregate parallel activities. The basic procedures are described below.

Based on the labels of training events $\{e_1,\ldots,e_k\}$, it is possible to collect training instances for each activity state, such as types A, B and C. For simplicity, in this disaggregation step, only a single feature (the total water consumption) is considered for each event $e_i$. Each single-activity related event ($E_t$) can modeled by a Gaussian mixture distribution as $\Sigma_t\sim\Sigma_{i=1}^m\pi_i\mathcal{N}(\mu_i,\sigma_i^2)$, where $\pi_i$ is the prior probability of the activity state i, and $\mathcal{N}(\mu_i,\sigma_i^2)$ is the event distribution of activity i.

Given an event $e_t$ that is classified as parallel activities, the objective is to identify the most probable hidden activities $((a_{t1},e_{t1}),\ldots,(a_{t5}e_{t5}))$ with $Agg(e_{t1},\ldots,e_{ts})=e_t$. Here the aggregation function Agg is the summation function $\Sigma(\bullet)$. The GDF disaggregation framework can be employed here, which can be regarded a simplified case of HMM based approach.

Evaluation & Findings

The framework has been implemented using Java JDK 1.5 software and deployed in the Custom Analytics Layer of the architecture shown in FIG. 3 Pie charts of activity consumption distribution are generated to illustrate how each fixture has been used on monthly basis. From the Smarter Water Service layer interface, the residents can browse their own consumption distribution; meanwhile, the government agency and utility manager can explore how water has been consumed by each activity at regional level.

Both HMM-based and GMM-based approaches have been implemented and evaluated. Specifically, for the GMM-based approach, three classification methods have been assessed, k-Nearest Neighbor classification (kNN-GMM), Artificial Neural Network (ANN-GMM), and Support Vector Machine (SVM-GMM). Given the available labeled activities, the evaluation focused on identifying type A, B and C uses.

To evaluate the effectiveness of consumption disaggregation on identifying these activities, three metrics have been adopted: precision, recall, and F-measure. The major reason of using these metrics is that the disaggregation evaluation is similar to an information retrieval process, where subsets of intervals represent certain true activities and the testing results are also subsets of intervals labeled as activities. The metrics need to capture not only how many labels are matched, but also how many true activities are missed and how many false labels are placed. These metrics are defined as follows: Precision refers to the portion of matched activities within the corresponding disaggregation results; Recall refers to the portion of matched activities within the corresponding true activities; F-measure is the harmonic mean of precision and recall.

To evaluate the proposed disaggregation solution, both HMM-based and GMM-based approaches have been applied on the consumption of six (6) volunteer households, as well as fifty (50) simulation datasets that were generated based on their labeled consumption. In addition, the sample rate in these datasets was varied to investigate its impact on disaggregation results. The correlation between sample rate and effectiveness can provide guidance to future planning and deployment of activity analysis applications.

Due to the lack of labeled activities from most of the pilot households, the HMM-based model was only applied to analyze activities of the 300+ pilot households. Patterns discovered can illustrate common behavior characteristics.

Datasets

A real-world dataset was collected from six (6) volunteer households. It consists of 1/10 Hz water reading and the corresponding usage journaling records for seven (7) days. The usage journaling was input manually by these volunteers, so it always has approximated timestamps and missing activities, which introduce inaccuracy which needs to be handled carefully. It should be noted that these households came from various demographic categories and showed significantly different consumption patterns. A summary of labeled activities from one volunteer is listed in the table of FIG. 14.

Fifty (50) simulation datasets were generated by simulating occurrences and corresponding consumption of activities according to their distributions in the labeled dataset from the six volunteer households. Firstly, from the labeled activities, the number of instances of each activity in a week was estimated using Poisson distribution. Each instance was randomly assigned to a day and time according to the distributions of labeled activities in day-of-week and time-of-day domains. These distributions were captured by activity occurrence histograms generated from labeled activities and smoothed by kernel density. Once date and start time of an instance was determined, its consumption and duration was randomly picked from a dictionary of the corresponding labeled activities. Finally, consumption noise of each day was randomly picked from forty-two (42) (6 households*7 days) samples, of which each contains unlabeled consumption (<2 gallons) of a whole day. In this way, simulated consumption data for six (6) months was generated in each dataset.

A live dataset was constructed from the 15-min consumption of all the pilot households. This dataset has inconsistent reading intervals, missing readings due to communication failure, and even water leaks that can impair the disaggregation results. The present invention provides the capability of addressing such a dataset despite the many inconsistencies.

Parameter Settings & Baseline Methods

For the HMM-based approach, the major settings are as follows: 1) in GDF Phase 1 (event extraction) Step 3 (merging heavy events), the threshold $\theta$ was set to 5.5 gallons; 2) in GDF Phase 1 (event extraction) Step 5 (merging peak events), the thresholds $\tau$ and $\gamma$ were set to 15 minutes and 20 gallons, respectively; 3) in GDF Phase 2 (HMM parameter estimation) Step 4 (cluster labeling), the clusters with mean consumption between 1.2 gallon and 6 and frequency greater than two times per day were labeled as type A uses; the clusters with mean consumption between 8 and 30 were labeled as Type C; the clusters with mean consumptions between 30 and 55 gallons were labeled as Type B; the clusters with frequency smaller than 1 times per day were disregarded; and the left clusters were labeled as "others"; 4) the number of states in HMM was decided automatically (See GDF Phase 2 step 3). It should be noted that all the preceding parameters were decided based on domain experiences.

For kNN-GMM-based approach, the event extraction phase was the same as that in HMM-based approach. The same event extraction process was also used in all other compared approaches. The kNN classifier used in the experiments was provided by MATLAB-2008a Bioinformatics Toolbox, available from MathWorks. One major parameter is the number of nearest neighbors used in the classification. 10-folder cross validation was applied to select the best k from the candidate values from 5 to 15.

For ANN-GMM-based approach, the neural network classifier was provided by MATLAB 2008a Neural Network Toolbox. One-per-class cording for multiclass classification was employed. In one-per-class coding, each output neuron is designated the task of identifying a given class. The output code for that should be 1 at this neuron and 0 for others. Levenberg-Marquardt back propagation, which is the default training algorithm in MATLAB, was used. 10-folder cross validation was used to select the best parameter "the number of hidden layers" in the range from 2 layers to 8 layers. Other parameters were the default settings. Another popular training algorithm is "Gradient descent back propagation" with two major parameters "learning rate" and "the number of hidden layers". The Levenberg-Marquardt back propagation method is more accurate and efficient, and accordingly preferred.

For SVM-GMM-based approach, the SVM classifier was provided by integrated software for support vector classification, namely LIBSVM. The popular radial basis function was used as the kernel function. There are two parameters including cost (c) and gamma (g). These two parameters were tuned by 10-folder cross validations, and the best parameters was selected from different combinations of the cost parameter (c) range: $\log_2(c)=1:0.25:5$, and the gamma parameter (g) range: $\log_2(g)=-7:0.25:-1$. The "one-against-one" method for multiclass classification was used.

Two baseline approaches, named random-pick and knapsack based, were applied to evaluate the effectiveness of the above four proposed methods. The random-pick method is described as follows: First, conduct the same event extraction as in HMM-based method; second, the events with consumption smaller than two (2) gallons are labeled as Type E uses; third, the left events are randomly labeled as type A, B and C uses.

The knapsack based method is described as follows: First, conduct the same event extraction as in HMM-based method; second, knapsack each segment to the best combination of the following activities: "Type A fixture-new (1.6 gallons)", "Type A fixture-old (4 gallons)", "Type C-Low-flow (15 gallons)", "Type C-Standard (30 gallons)", "Type B (50 gallons)", and "Type E (<=1.6)".

Effectiveness Comparison

To demonstrate the effectiveness of proposed approaches, the labeled activities from water journaling and the simulation datasets were used as ground truth, and compared the proposed approaches. The comparison was conducted among four (4) versions of disaggregation approaches, HMM, kNN-GMM, ANN-GMM, and SVM-GMM; and the two baseline solutions, random pick and knapsack. Cross validation was applied to find the best parameters for the corresponding classification methods.

As shown in the table of FIG. 15, all the proposed approaches achieved about 95% precision on Type C usage identification, while the recall was relatively low (77~81%).

It was because the deviation of shower consumption is very high in real life. In many cases, consumption using a Type C fixture may be similar to that of two type A uses, or a Type B use. Therefore, some true Type C uses could not be correctly identified. But once an activity is labeled as a Type C use, it's very likely to be true. Although these four methods performed similarly on labeling Type C uses, SVM-GMM achieved the highest scores.

Different from Type C uses, Type B uses were disaggregated with very high recall (89~96%) and relatively low precision (78~86%). Generally, clothes washing is the heaviest and meanwhile the least frequent activity on water consumption in a household. Based on the specifications and settings of a Type B appliance, its water consumption is usually consistent. That's the reason why almost all of the Type B uses can be learned and identified. On the other hand, a Type B usage usually crosses multiple intervals. This usage pattern may be similar to certain combinations of other consumption. Therefore, some other consumption was classified as Type B by the disaggregation approaches. In total, SVM-GMM achieved the best overall performance, and HMM got the highest recall.

Detecting type A uses is the most difficult task as compared to Type B and C use. Because type A fixture usage typically happens very frequently and costs a small amount of water, it is hard to distinguish from sink usage in a 15-minute interval, or be identified when combined with heavy activities such as a Type B or C use. All the four approaches had F-measure between 61% and 78%. HMM was the only approach with precision higher than recall. KNN-GMM performed the best in terms of F-measure.

Due to the small number of training data (<=four (4) days per house), GMM-based approaches failed to disaggregate consumption on the volunteer households. As shown in the table of FIG. 16, HMM perfectly identified Type B usage, and disaggregated Type C use with high scores. The F-measure for type A fixture disaggregation with HMM only achieved 55%, although still much better than the baselines.

Impact of Sample Rate

Figure 5:
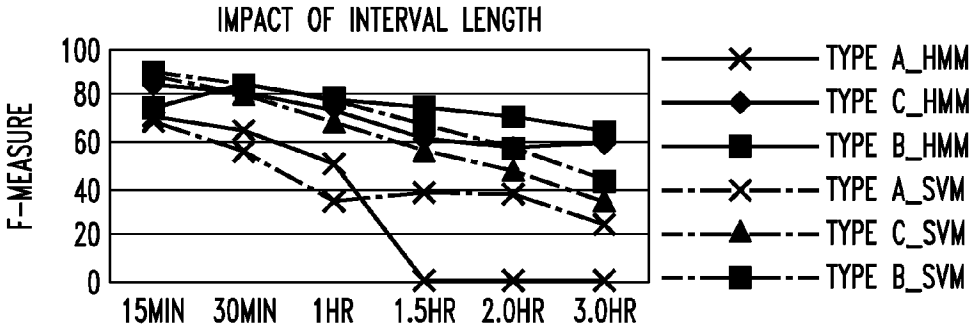
FIG. 5 is a graph showing the impact of reading interval length on disaggregation.
Figure 6A:
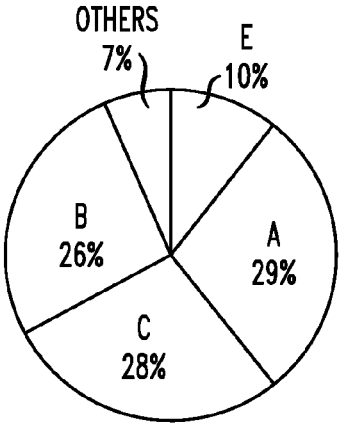
FIGS. 6A-6E are pie charts showing disaggregation results as a function of household demographics.
Figure 6B:
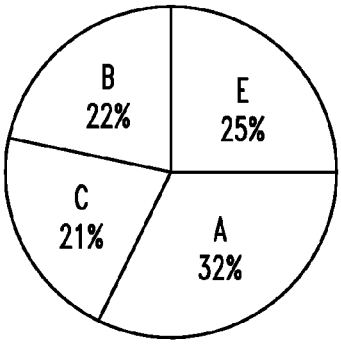
Figure 6C:
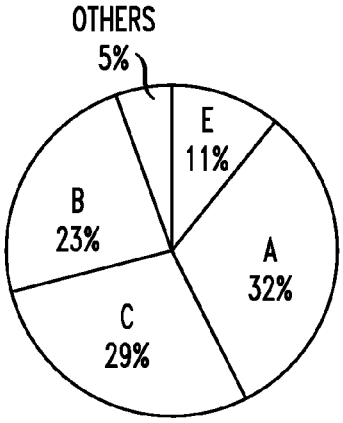
Figure 6D:
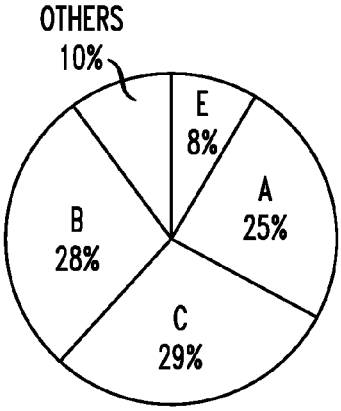
Figure 6E:
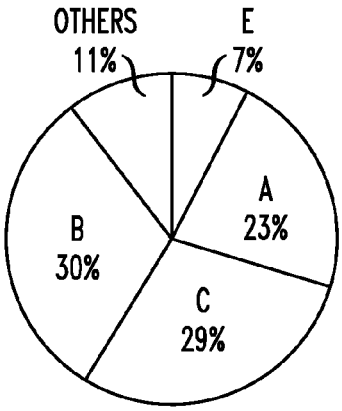

Choosing an appropriate sample rate for smart meter deployment is a very important decision that may affect hardware and maintenance cost. This set of experiments can provide practical suggestions from the requirement of activity analysis. Reading intervals of the simulation datasets were varied from 15 min to 3 hours in this set of experiments to evaluate its impact on the accuracy of disaggregation results. Both HMM and GMM methods were evaluated in this set of experiments. SVM-GMM was selected to represent GMM, because it had shown practically good accuracy and efficiency in previous experiments. As suggested in FIG. 5, both 15 and 30 min intervals provide acceptable results. 1 hour interval supports fair disaggregation of Type B and C uses, but cannot identify more than half of type A uses.

Disaggregation for Pilot Households

The proposed HMM-based approach has been applied on 300+ pilot households with 15 minute meter readings. Hidden Markov models were constructed for each household, and water consumption was disaggregated into activities to provide insights to residents and the city management team. Patterns discovered from the disaggregation results are discussed in the following paragraphs.

By combining with demographic survey results, the consumption distribution of different types of households is first summarized in pie charts as shown in FIG. 6. Each pie chart shows the portion of water for each activity by a given group of households. The consumption that cannot be disaggregated is included in category 'others'. The consumption distribution of all the pilot households is illustrated in FIG. 6A, where type A and C fixtures used about 30% each, and Type B appliances used about 25%. Households with a single occupant (FIG. 6B) showed different usage pattern, where Type C fixtures only consumed 21% of the overall usage and Type B use reduced to 22%. FIG. 6C shows the pie chart for households with two adults only. Compared to the single adult households, households of two adults consumed significantly more in Type C usage. On the other hands, children in general caused more Type B usage. As shown in FIGS. 6D and 6E, households with children (kids) brought Type B usage to 28%, and more specifically, households with toddlers had increased Type B usage further to 30%. By comparison, a resident can easily figure out on which activity his or her household needs more efforts to conserve water.

Figure 7A:
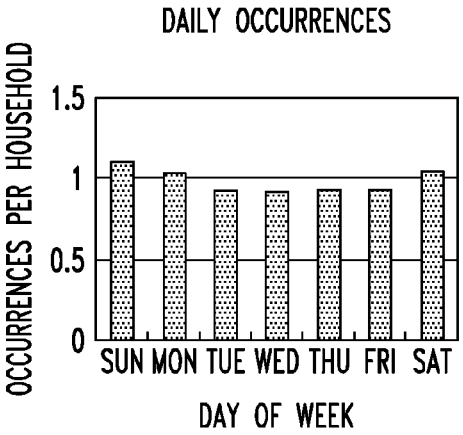
FIGS. 7A and 7B show washer usage as a function of days of a week.
Figure 7B:
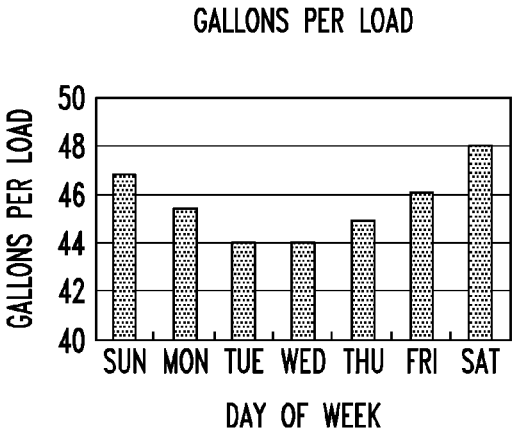

Temporal patterns of Type B and C usage have been identified from the disaggregation results. As shown in FIG. 7A, the pilot households preferred to use the Type B appliance during weekends, and each weekday there was about 0.9 Type B appliance use per household in average. The number and size of each Type B use increased in weekends. FIG. 7B illustrates that each Type B use on Saturday used 9% more water than a Type B use on Tuesday or Wednesday. This is reasonable because usually heavy laundry is saved for weekends.

Figure 8A:
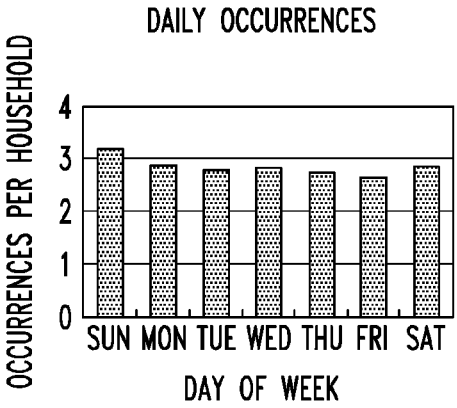
FIGS. 8A and 8B show shower usage as a function of days of a week.
Figure 8B:
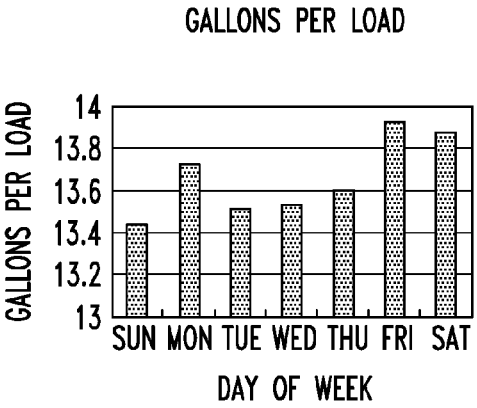

As shown in FIG. 8A, more Type C uses occurred during the weekend days. However, as shown in FIG. 8B, an average Type C use on Sunday used the least water in a week, which was 10% less than one on Saturday. Furthermore, a Type C use on Friday consumed the highest amount of water in a week. It is possible that people wanted to relax and enjoy longer Type C use on Friday, while the stress from work arrived early on Sunday.

Figure 9A:
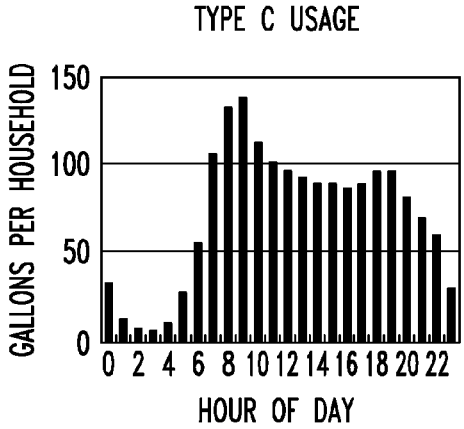
FIGS. 9A and 9B show shower and washer usage, respectively, as a function of time of day.
Figure 9B:
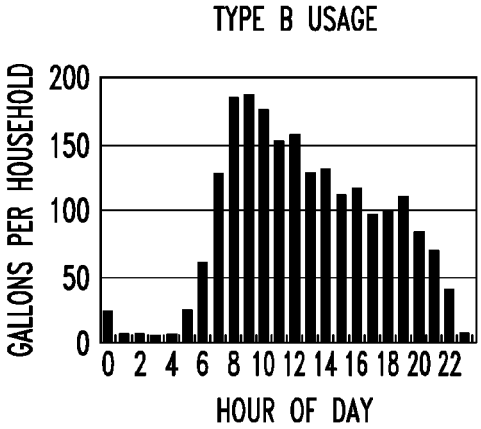

FIGS. 9A and 9B demonstrate, respectively, the time of day distributions of Type B and C use across the pilot households. As expected, the peaks of Type C use happened during 8~9 am and 6~7 pm in a day, which are before and after work. Type B usage showed a similar distribution, although the pm peak was not significant. That consistency could be explained as many Type B uses occurred right after a Type C use to handle the changed clothes.

The absence of high frequency consumption data is overcome in accordance with the principles of the present invention by employing knowledge that certain usage activities are associated either with each other or with certain days or time of day. It has been found that many occurrences of utility consumption activities are correlated. Such correlations can be learned and modeled from historical consumption readings and applied to remove ambiguities in consumption disaggregation. Type C uses, for example, usually take place either close to the first event of usage in the morning or close to the first event following work hours. Type A uses are usually followed by short Type E usage. Associations among consumption activities can be learned for individual residences. The associations can improve consumption disaggregation on coarse granular readings such as those obtained by the water meters used for data collection as discussed above.

Figure 10:
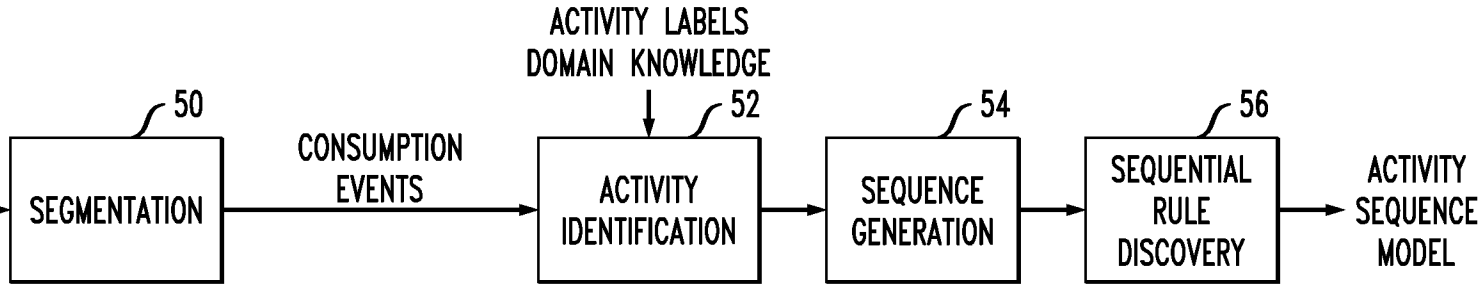
FIG. 10 is a flow chart showing a training process used for association based disaggregation.

Association based disaggregation can be implemented in two basic steps, namely training followed by disaggregation. The training step constructs disaggregation models based on observations and domain knowledge. In this step, both consumption activities and association among consumption activities are extracted to formulate activity consumption patterns. The flow chart shown in FIG. 10 illustrates, in general terms, an exemplary training process that can employ one or more of the specific analytical procedures discussed above. Meter readings are employed in a segmentation step 50 that extracts consumption events. Activity identification 52, based on user inputs and/or domain knowledge, is obtained from the consumption events. Based on the activity identification, a sequence generation step 54 generates consumer activity sequences. The step 56 of sequential rule discovery involves the discovery of frequent sequences (e.g. Type E usage following type A fixture usage) having statistical significance. An activity sequence model is obtained through such training, and is used in the exemplary disaggregation procedure shown in FIG. 11.

Figure 11:
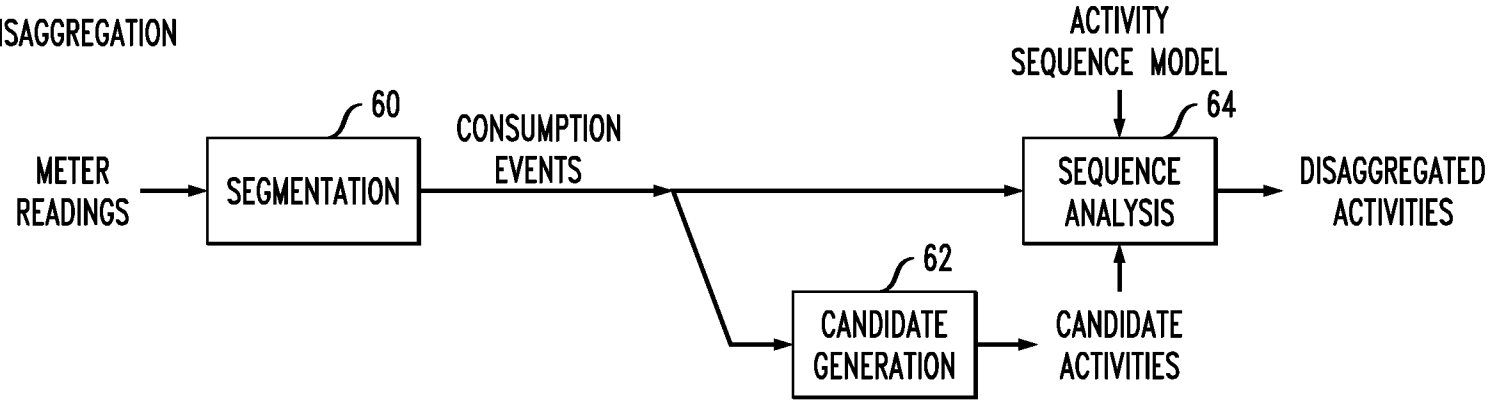
FIG. 11 is a flow chart showing a disaggregation process.

Disaggregation of meter readings is facilitated by the invention, particularly readings that are taken at long cycle intervals and generate only aggregated volume and start time consumption data. This step applies the disaggregation models to identify the consumption activities based on the utility readings. New activities can be identified, for example, according to the consumption amount as well as the previous activities. Referring to FIG. 11, a segmentation step 60 is employed to extract usage events. A candidate generation step 62 generates candidate activities based on consumption. This step comprises several of the steps discussed above with respect to FIG. 4, namely parallel activities detection, parallel size estimation and hidden activity identification Sequence analysis 64, which includes consumption decomposition as discussed above with respect to FIG. 4, is based on sequential rules (the activity sequence model) and candidate activities to identify the best candidate. Disaggregated activities comprising consumer consumption activities are identified from application of the activity sequence model to the data. For example, given an event having water consumption of thirteen (13) gallons, the candidate generation process may generate two sets of candidates: 1) three (3) type A uses, or 2) one (1) Type C use. Sequence analysis evaluates each combination of activities in the candidates by applying the sequence model and assigning the estimated consumption for each activity to the most likely candidate. If, for example, the event of thirteen (13) gallons consumption occurred in the middle of the day and two Type C uses were detected earlier the same day and two more Type C uses were detected later that day, the event more likely consists of three (3) type A uses than one Type C use based on the sequence model. Water consumption of 4.3 gallons is accordingly assigned to each type A use, i.e. the disaggregated activities.

As discussed above, the hidden Markov model can be employed for implementation of the activity sequence model used for disaggregation of utility consumption into particular activities. For example, to disaggregate water consumption into major activities including types A, B, C and E use, the HMM parameters are estimated in the training process. Specifically, for constructing the HMM model, it is necessary to segment the consumption stream into separate events, identify frequent events relating to water consumption, label simple usages without overlap such as type A and E use, remove anomalies, and estimate the hidden states as well as transition matrix and probabilities. In the identifying process, the sequence analysis is performed based on the constructed HMM to identify parallel and non-parallel activities. The HMM takes the transition matrix to represent potential sequences and therefore finds the set of activities that best match the sequential patterns.

In general terms, the invention employs a learning algorithm to discover the association among consumption activities, for example type A fixture usage followed by Type C use followed by Type B use. This association map allows the decomposition of aggregate consumption into activity-based consumption accurately and effectively without requiring any per activity or per device monitoring or metering.

Given the discussion thus far, it will be appreciated that, in general terms, an exemplary method according to an aspect of the invention includes obtaining an activity sequence model correlating utility consumption patterns with particular utility consumption activities, transmitting aggregated utility consumption data from a utility meter at time intervals, obtaining a sequence of the aggregated utility consumption data collected at the time intervals, and disaggregating the sequence of aggregated utility consumption data into consumption activities using the activity sequence model.

An exemplary system according to a further aspect of the invention includes an information receiving device configured to receive sequences of aggregated utility interval consumption data, a storage device for electronically storing the received sequences of aggregated utility consumption data, a storage device comprising an activity sequence model correlating utility consumption patterns with particular utility consumption activities, and a processing device configured to disaggregate the sequences of aggregated utility consumption data into utility consumption activities by applying the activity sequence model to the received sequences of aggregated utility consumption data. As discussed above, much of the system can be incorporated in a computing cloud as shown in FIGS. 2 and 3.

Exemplary System and Article of Manufacture Details and Exemplary Cloud Computing Architecture As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

One or more embodiments of the invention, or elements thereof, can be implemented in the form of an apparatus including a memory and at least one processor that is coupled to the memory and operative to perform exemplary method steps.

Figure 12:
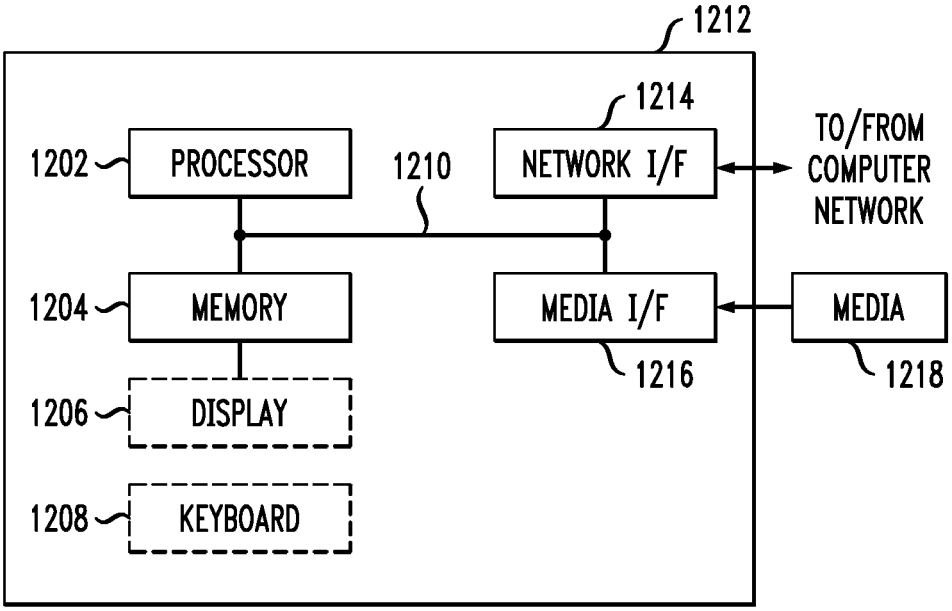
FIG. 12 depicts a computer system that may be useful in implementing one or more aspects and/or elements of the invention.

One or more embodiments can make use of software running on a general purpose computer or workstation. With reference to FIG. 12, such an implementation might employ, for example, a processor 1202, a memory 1204, and an input/output interface formed, for example, by a display 1206 and a keyboard 1208. The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like. In addition, the phrase "input/output interface" as used herein, is intended to include, for example, one or more mechanisms for inputting data to the processing unit (for example, mouse), and one or more mechanisms for providing results associated with the processing unit (for example, printer). The processor 1202, memory 1204, and input/output interface such as display 1206 and keyboard 1208 can be interconnected, for example, via bus 1210 as part of a data processing unit 1212. Suitable interconnections, for example via bus 1210, can also be provided to a network interface 1214, such as a network card, which can be provided to interface with a computer network, and to a media interface 1216, such as a diskette or CD-ROM drive, which can be provided to interface with media 1218.

Accordingly, computer software including instructions or code for performing the methodologies of the invention, as described herein, may be stored in one or more of the associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 1202 coupled directly or indirectly to memory elements 1204 through a system bus 1210. The memory elements can include local memory employed during actual implementation of the program code, bulk storage, and cache memories which provide temporary storage of at least some program code in order to reduce the number of times code must be retrieved from bulk storage during implementation.

Input/output or I/O devices (including but not limited to keyboards 1208, displays 1206, pointing devices, and the like) can be coupled to the system either directly (such as via bus 1210) or through intervening I/O controllers (omitted for clarity).

Network adapters such as network interface 1214 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 1212 as shown in FIG. 12) running a server program. It will be understood that such a physical server may or may not include a display and keyboard.

As noted, aspects of the present invention may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Media block 1218 is a non-limiting example. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, such as those provided in FIGS. 4, 10 and 11 can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowcharts and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be noted that any of the methods described herein can include an additional step of providing a system comprising distinct software modules embodied on a computer readable storage medium; the modules can include, for example, any or all of the elements depicted in the block diagrams and/or described herein; by way of example and not limitation, a training module for generating an activity sequence model as shown in the exemplary embodiment of FIG. 10 and a disaggregation module for generating disaggregated activities as shown in the exemplary embodiment of FIG. 11. Other non-limiting examples of modules and/or sub-modules include the blocks 40, 42, 44, 46, and/or 48 in FIG. 3; and the blocks in FIG. 4. The method steps can then be carried out using the distinct software modules and/or sub-modules of the system, as described above, executing on one or more hardware processors 1202 and/or 1716. Further, a computer program product can include a computer-readable storage medium with code adapted to be implemented to carry out one or more method steps described herein, including the provision of the system with the distinct software modules.

In any case, it should be understood that the components illustrated herein may be implemented in various forms of hardware, software, or combinations thereof; for example, application specific integrated circuit(s) (ASICS), functional circuitry, one or more appropriately programmed general purpose digital computers with associated memory, and the like. Given the teachings of the invention provided herein, one of ordinary skill in the related art will be able to contemplate other implementations of the components of the invention.

It should also be noted that one or more embodiments can make use of cloud computing technology. Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based email). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load balancing between clouds).

A cloud computing environment is service oriented with a focus on statelessness, low coupling, modularity, and semantic interoperability. At the heart of cloud computing is an infrastructure comprising a network of interconnected nodes.

Figure 17:
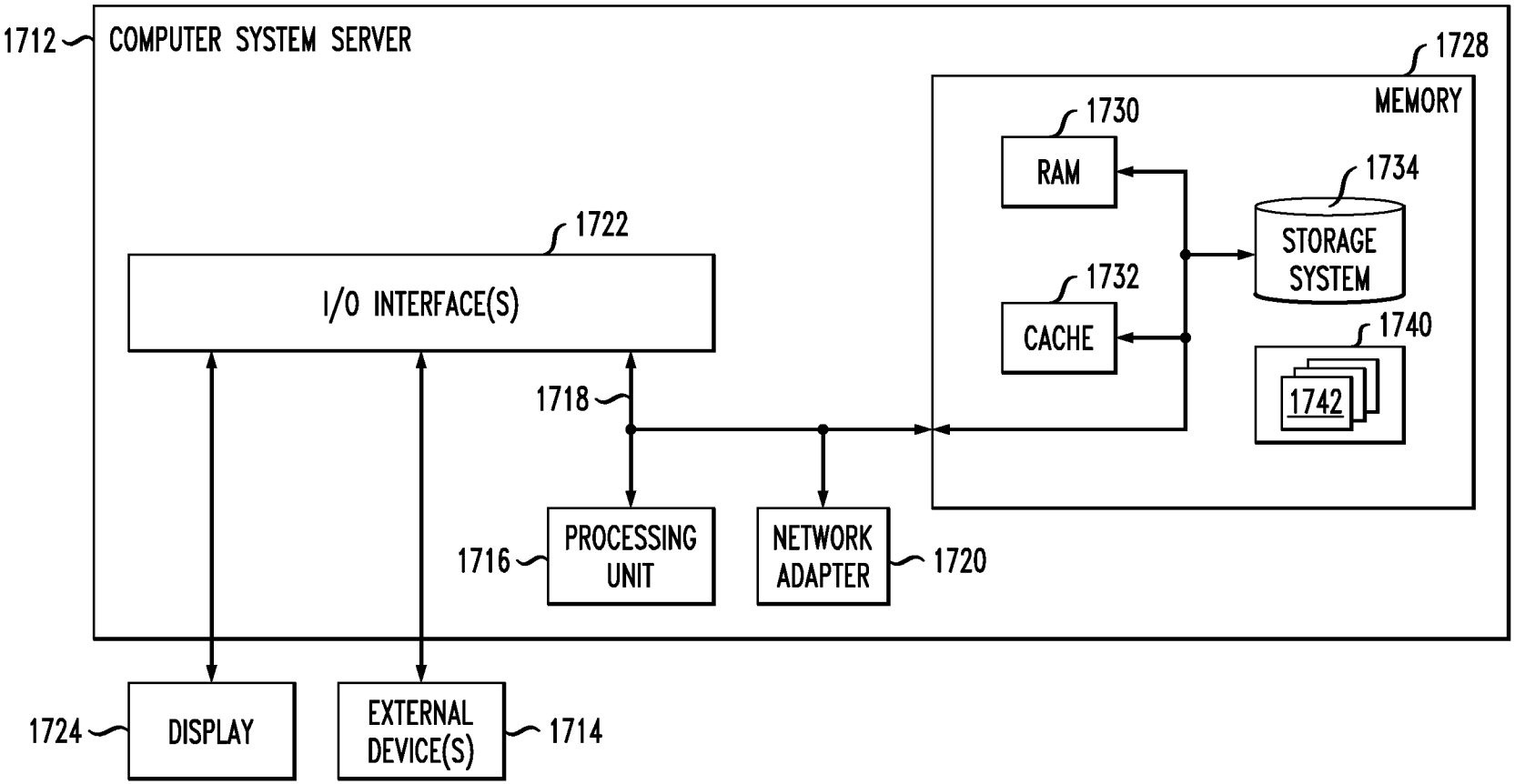
FIG. 17 depicts a cloud computing node according to an embodiment of the present invention.

Referring now to FIG. 17, a schematic of an example of a cloud computing node is shown. Cloud computing node 1710 is only one example of a suitable cloud computing node and is not intended to suggest any limitation as to the scope of use or functionality of embodiments of the invention described herein. Regardless, cloud computing node 1710 is capable of being implemented and/or performing any of the functionality set forth herein.

In cloud computing node 1710 there is a computer system/server 1712, which is operational with numerous other general purpose or special purpose computing system environments or configurations. Examples of well-known computing systems, environments, and/or configurations that may be suitable for use with computer system/server 1712 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 1712 may be described in the general context of computer system executable instructions, such as program modules, being executed by a computer system. Generally, program modules may include routines, programs, objects, components, logic, data structures, and so on that perform particular tasks or implement particular abstract data types. Computer system/server 1712 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 17, computer system/server 1712 in cloud computing node 1710 is shown in the form of a general-purpose computing device (similar to the example in FIG. 12). The components of computer system/server 1712 may include, but are not limited to, one or more processors or processing units 1716, a system memory 1728, and a bus 1718 that couples various system components including system memory 1728 to processor 1716.

Bus 1718 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 1712 typically includes a variety of computer system readable media. Such media may be any available media that is accessible by computer system/server 1712, and it includes both volatile and non-volatile media, removable and non-removable media.

System memory 1728 can include computer system readable media in the form of volatile memory, such as random access memory (RAM) 1730 and/or cache memory 1732. Computer system/server 1712 may further include other removable/non-removable, volatile/non-volatile computer system storage media. By way of example only, storage system 1734 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 1718 by one or more data media interfaces. As will be further depicted and described below, memory 1728 may include at least one program product having a set (e.g., at least one) of program modules that are configured to carry out the functions of embodiments of the invention.

Program/utility 1740, having a set (at least one) of program modules 1742, may be stored in memory 1728 by way of example, and not limitation, as well as an operating system, one or more application programs, other program modules, and program data. Each of the operating system, one or more application programs, other program modules, and program data or some combination thereof, may include an implementation of a networking environment. Program modules 1742 generally carry out the functions and/or methodologies of embodiments of the invention as described herein.

Computer system/server 1712 may also communicate with one or more external devices 1714 such as a keyboard, a pointing device, a display 1724, etc.; one or more devices that enable a user to interact with computer system/server 1712; and/or any devices (e.g., network card, modem, etc.) that enable computer system/server 1712 to communicate with one or more other computing devices. Such communication can occur via Input/Output (I/O) interfaces 1722. Still yet, computer system/server 1712 can communicate with one or more networks such as a local area network (LAN), a general wide area network (WAN), and/or a public network (e.g., the Internet) via network adapter 1720. As depicted, network adapter 1720 communicates with the other components of computer system/server 1712 via bus 1718. It should be understood that although not shown, other hardware and/or software components could be used in conjunction with computer system/server 1712. Examples, include, but are not limited to: microcode, device drivers, redundant processing units, external disk drive arrays, RAID systems, tape drives, and data archival storage systems, etc.

Figure 18:
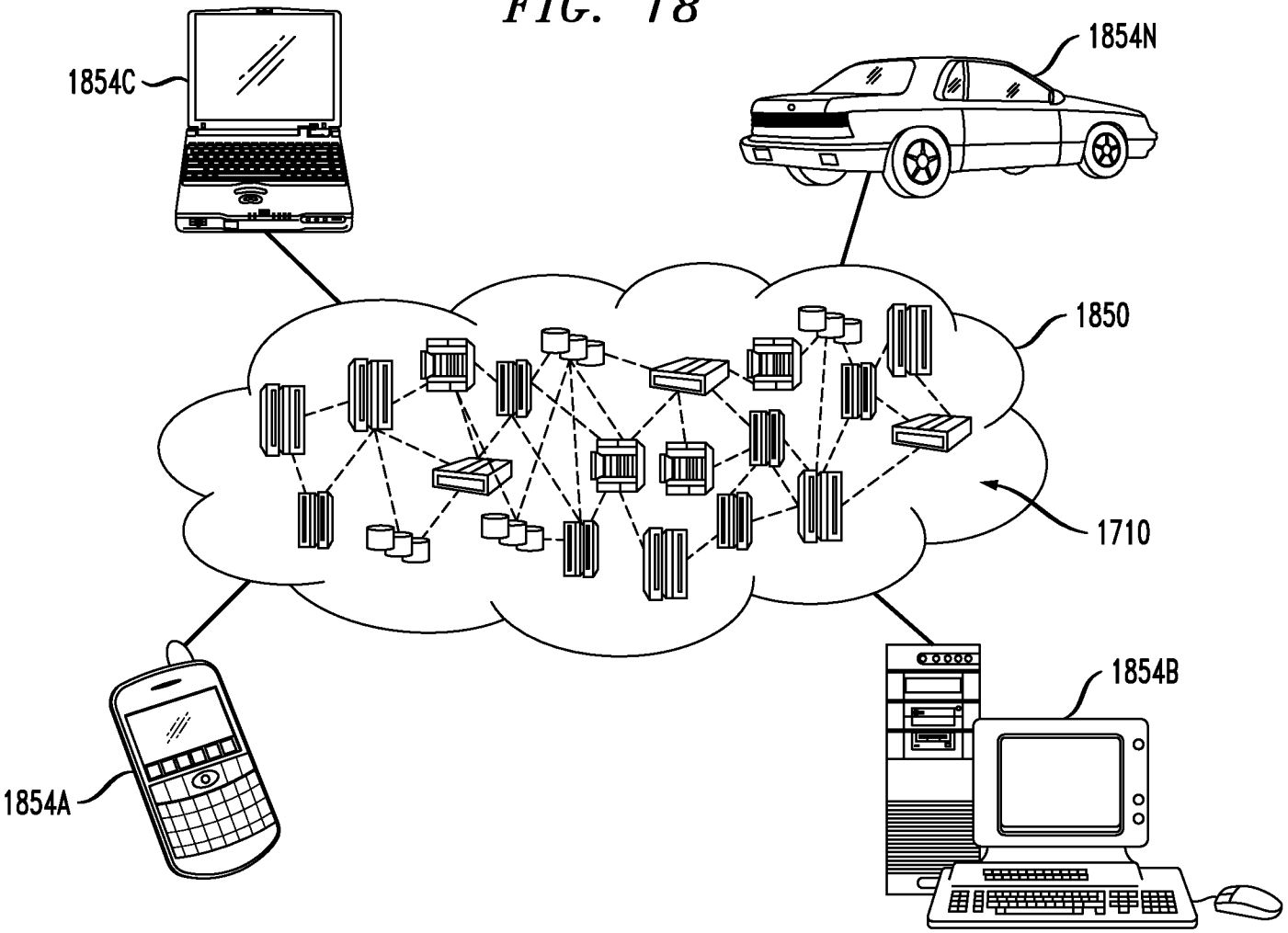
FIG. 18 depicts a cloud computing environment according to an embodiment of the present invention.

Referring now to FIG. 18, illustrative cloud computing environment 1850 is depicted. As shown, cloud computing environment 1850 comprises one or more cloud computing nodes 1710 with which local computing devices used by cloud consumers, such as, for example, personal digital assistant (PDA) or cellular telephone 1854A, desktop computer 1854B, laptop computer 1854C, and/or automobile computer system 1854N may communicate. Nodes 1710 may communicate with one another. They may be grouped (not shown) physically or virtually, in one or more networks, such as Private, Community, Public, or Hybrid clouds as described hereinabove, or a combination thereof. This allows cloud computing environment 1850 to offer infrastructure, platforms and/or software as services for which a cloud consumer does not need to maintain resources on a local computing device. It is understood that the types of computing devices 1854A-N shown in FIG. 18 are intended to be illustrative only and that computing nodes 1710 and cloud computing environment 1850 can communicate with any type of computerized device over any type of network and/or network addressable connection (e.g., using a web browser).

Figure 19:
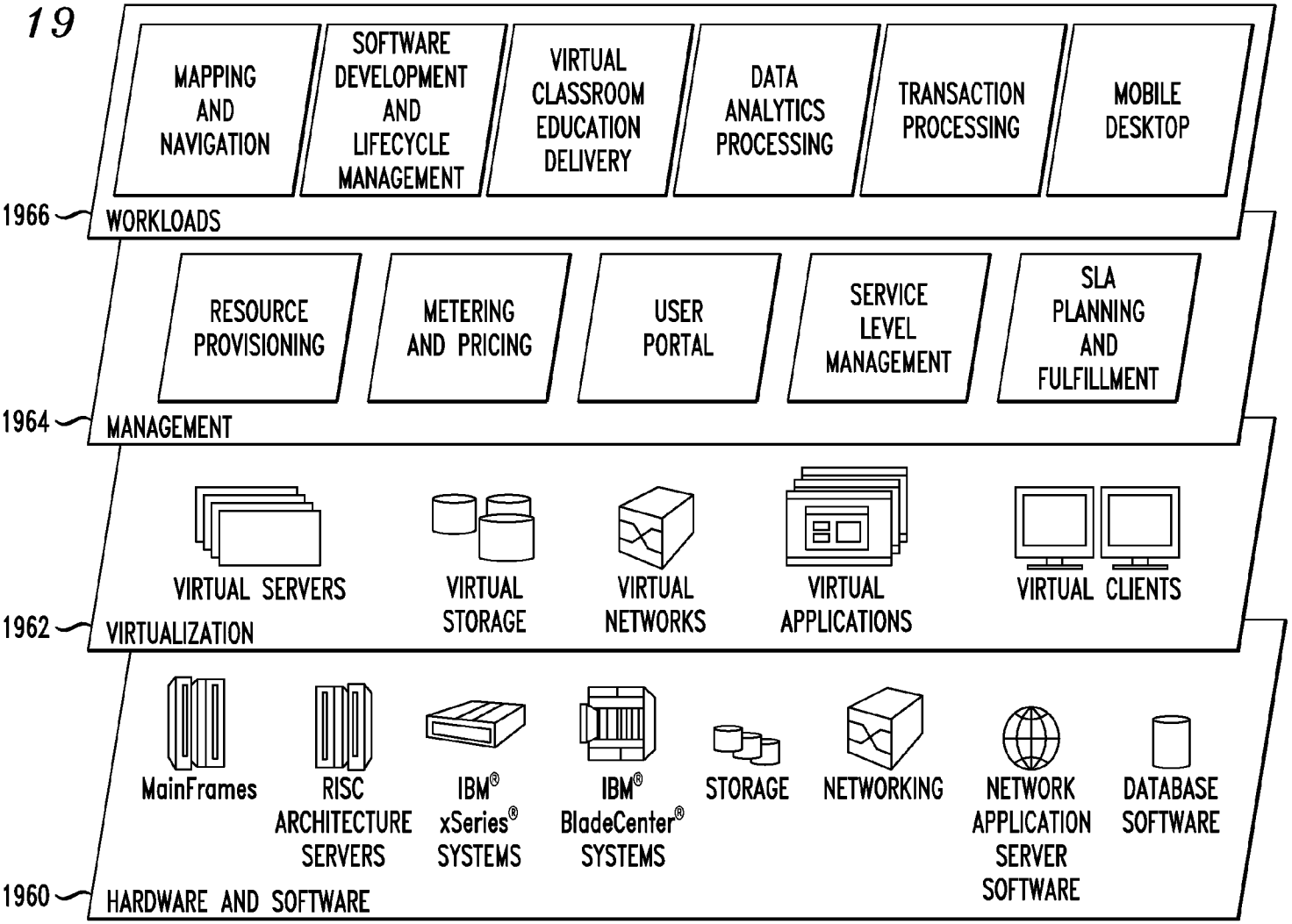
FIG. 19 depicts abstraction model layers according to an embodiment of the present invention.

Referring now to FIG. 19, a set of functional abstraction layers provided by cloud computing environment 1850 (FIG. 18) is shown. It should be understood in advance that the components, layers, and functions shown in FIG. 19 are intended to be illustrative only and embodiments of the invention are not limited thereto. As depicted, the following layers and corresponding functions are provided:

Hardware and software layer 1960 includes hardware and software components. Examples of hardware components include mainframes, in one example IBM® zSeries® systems; RISC (Reduced Instruction Set Computer) architecture based servers, in one example IBM pSeries® systems; IBM xSeries® systems; IBM BladeCenter® systems; storage devices; networks and networking components. Examples of software components include network application server software, in one example IBM WebSphere® application server software; and database software, in one example IBM DB2® database software. (IBM, zSeries, pSeries, xSeries, BladeCenter, WebSphere, and DB2 are trademarks of International Business Machines Corporation registered in many jurisdictions worldwide).

Virtualization layer 1962 provides an abstraction layer from which the following examples of virtual entities may be provided: virtual servers; virtual storage; virtual networks, including virtual private networks; virtual applications and operating systems; and virtual clients.

In one example, management layer 1964 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide pre-arrangement for, and procurement of, cloud computing resources for which a future requirement is anticipated in accordance with an SLA.

Workloads layer 1966 provides examples of functionality for which the cloud computing environment may be utilized. Examples of workloads and functions which may be provided from this layer include: mapping and navigation; software development and lifecycle management; virtual classroom education delivery; data analytics processing; transaction processing; mobile desktop; and, of course, any portion or all of the utility consumption disaggregation techniques disclosed herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method comprising:

obtaining an activity sequence model correlating utility consumption patterns with particular utility consumption activities;

transmitting aggregated utility consumption data including only aggregated volume and start time consumption data over time intervals of fifteen minutes or more from a utility meter operatively associated with a plurality of appliances or fixtures;

obtaining a sequence of the aggregated utility consumption data collected during the time intervals, and disaggregating the sequence of aggregated utility consumption data into disaggregated consumption activities using the activity sequence model, the step of disaggregating further including detecting anomalous events within the time intervals and detecting parallel consumption activities in the time intervals from the anomalous events.

2. The method of claim 1, wherein the utility consumption patterns are based on fixture usage patterns, household dependent patterns and time dependent patterns.

3. The method of claim 2, wherein the activity sequence model comprises a hidden Markov model.

4. The method of claim 2, wherein the activity sequence model comprises a Gaussian mixture model.

5. The method of claim 2, wherein the time dependent patterns comprise utility consumption activities associated with each other.

6. The method of claim 1, wherein the step of obtaining the activity sequence model includes obtaining meter readings, extracting consumption events from the meter readings, identifying consumption activities from the consumption events, generating consumer activity sequences based on the identified consumption activities, identifying consumer activity sequences having statistically significant frequencies, and using the identified consumer activity sequences having statistically significant frequencies to obtain the activity sequence model.

7. The method of claim 1, wherein the utility meter is a water meter.

8. A system comprising:

an information receiving device configured to receive sequences of aggregated utility interval consumption data including only aggregated volume and start time consumption data over time intervals;

a storage device for electronically storing the received sequences of aggregated utility interval consumption data;

a storage device comprising an activity sequence model correlating utility consumption patterns with particular utility consumption activities, and a processing device configured to disaggregate the sequences of aggregated utility interval consumption data into disaggregated utility consumption activities by applying the activity sequence model to the aggregated volume and start time consumption data in the received sequences of aggregated utility interval consumption data, the processing device being further configured to:

group intervals from the sequences with continuous consumption to generate events representing one activity or parallel activities, use the activity sequence model to identify events that are anomalous, for each anomalous event, estimate the number of parallel activities, detect events that are abnormal, for each abnormal event, estimate hidden parallel activities, and estimate utility consumption of the hidden parallel activities.

9. The system of claim 8, wherein the activity sequence model correlates a first selected consumer consumption activity with a second selected consumer consumption activity.

10. The system of claim 9, further comprising a wireless gateway for collecting the aggregated utility interval consumption data, attaching timestamps thereto, and sending the aggregated utility interval consumption data with attached timestamps to the information receiving device.

11. The system of claim 10, further comprising one or more utility meters for transmitting aggregated utility interval consumption data at time intervals to the wireless gateway.

12. The system of claim 11, further comprising a computing cloud, the computing cloud comprising the information receiving device, the storage device for electronically storing the received sequences of aggregated utility interval consumption data, the storage device comprising the activity sequence model correlating utility consumption patterns with particular utility consumption activities, the processing device configured to disaggregate the sequences of aggregated utility interval consumption data into utility consumption activities, and a service layer for allowing users to browse the utility consumption activities.

13. The apparatus of claim 11, wherein the utility consumption patterns are based on fixture usage patterns, household dependent patterns and time dependent patterns.

14. The method of claim 8, wherein the activity sequence model comprises a hidden Markov model or a Gaussian mixture model.

15. The method of claim 8, wherein the time intervals are fifteen minutes or more.

* * * * *